US006343785B1

(12) United States Patent
Yamada et al.

(10) Patent No.: US 6,343,785 B1
(45) Date of Patent: Feb. 5, 2002

(54) FINISHER FOR AN IMAGE FORMING APPARATUS WITH A BINDING DEVICE THAT STACKS AND BINDS PAPERS

(75) Inventors: Kenji Yamada, Tokyo; Hiroki Okada, Kanagawa; Shinji Asami, Saitama, all of (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/533,932

(22) Filed: Mar. 23, 2000

(30) Foreign Application Priority Data

Mar. 23, 1999 (JP) ..... 11-078356
Feb. 3, 2000 (JP) ..... 12-026864

(51) Int. Cl.[7] ..... B42C 1/00
(52) U.S. Cl. ..... 270/58.08; 227/111
(58) Field of Search ..... 270/58.07, 58.08, 270/58.14, 58.18; 227/110, 111, 126, 156, 2, 120

(56) References Cited

U.S. PATENT DOCUMENTS

| | | | | |
|---|---|---|---|---|
| 4,508,329 A | * | 4/1985 | Hubler et al. | 270/58.08 |
| 5,054,766 A | * | 10/1991 | Seki et al. | 271/221 |
| 5,100,119 A | * | 3/1992 | Komada et al. | 270/58.14 |
| RE35,087 E | * | 11/1995 | Uto et al. | 270/58.09 |
| 6,264,191 B1 | | 7/2001 | Suzuki et al. | |

FOREIGN PATENT DOCUMENTS

| | | | |
|---|---|---|---|
| JP | 02-297493 | | 12/1990 |
| JP | 402297493 A | * | 12/1990 |
| JP | 6-122291 | | 5/1994 |
| JP | 09-136760 | | 5/1997 |
| JP | 409136760 A | * | 5/1997 |
| JP | 9-235070 | | 9/1997 |
| JP | 09/235070 | | 9/1997 |
| JP | 10-181985 | | 7/1998 |
| JP | 10-181989 | | 7/1998 |
| JP | 410181989 A | * | 7/1998 |
| JP | 2846376 | | 10/1998 |

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

In a finisher including at least one stapler for stapling a paper stack, and rotating it relative to the paper stack to thereby staple the paper stack either horizontally or obliquely, the stapler is supported by a support body including two axes of rotation relative to the paper stack. The support body includes a slider and a base. The stapler is rotated with the two axes of rotation rotating about each other, i.e., rotated about one axe of rotation by substantially 45° or about the other axis of rotation by substantially 90°. The finisher is miniature and easy to operate despite that the stapler is rotatable for oblique stapling or for the replenishment of staples.

24 Claims, 21 Drawing Sheets

FINISHER FOR AN IMAGE FORMING APPARATUS WITH A BINDING DEVICE THAT STACKS AND BINDS PAPERS

BACKGROUND OF THE INVENTION

The present invention relates to a printer, copier, facsimile apparatus or similar image forming apparatus and more particularly to a finisher operatively connectable to an image forming apparatus and including a binding device that stacks papers carrying images thereon and then binds them together.

A finisher for stacking papers on which images are formed by, e.g., a copier or a printer and then stapling them together at a preselected point has been proposed in various forms in the past. The stapler has customarily driven a staple into a paper stack in parallel to the trailing edge of the paper stack (horizontal stapling hereinafter). Today, a stapler capable of selectively performing horizontal stapling or oblique stapling, i.e., driving a staple obliquely into one corner portion of a paper stack is available, as proposed in, e.g., Japanese Patent Laid-Open publication Nos. 9-136760 and 10-181985. The staple with this capability can execute oblique stapling with either one of the leading edge and trailing edge of a paper stack, as desired. However, the recent digitization of an image forming apparatus has allowed images to be rotated and therefore allowed the stapler to perform oblique stapling only at the rear of paper stacks. The stapler can therefore deal with most sizes and orientations of papers in practice. In fact, some products available on the market execute the oblique stapling only at the rear of paper stacks.

The current trend in the finishers art is toward the replenishment of staples from the rear end of the stapler or binding means. This, however, brings about a problem that the stapler expected to staple the trailing edge of a paper stack is oriented in the direction of paper conveyance. In light of this, the finisher may be constructed such that the stapler can be pulled out together with a binding portion at the time of replenishment of staples, as proposed in the past. This kind of configuration, however, increases the number of parts constituting the finisher, complicates the construction and thereby increases the cost although it promotes easy staple replenishment. The above Laid-Open Publication Nos. 9-136760 and 10-181989 propose to staple either one of the front side and rear side of a paper stack, as desired, and to rotate the stapler by about 45° at the time of staple replenishment for promoting easy replenishment.

In the above conventional configuration, the axis of rotation of the stapler adjoins a clincher where a stapler is to be ejected, so that a paper stack can be stapled to substantially the same depth during both of horizontal stapling and oblique stapling. This, however, renders the front part of the finisher noticeably bulky.

Technologies relating to the present invention are also disclosed in, e.g., Japanese Patent Laid-Open Publication Nos. 6-122291 and 9-235070 and Japanese Patent No. 2,846,376.

SUMMARY OF THE INVENTION

It is therefore an object of the present invention to provide a finisher having a miniature configuration despite the rotation of binding means for oblique binding or staple replenishment.

It is another object of the present invention to provide a finisher allowing staples to be replaced by extremely easy operation.

It is a further object of the present invention to provide a finisher capable of setting a waiting position where stapling is not performed for thereby reducing loads on software and obviating mishandling.

In accordance with the present invention, in a finisher including at least one binding device for binding a paper stack, and rotating the binding device relative to the paper stack to thereby bind the paper stack either horizontally or obliquely, the binding device is supported by a support body including two axes of rotation relative to the paper stack.

The binding means may be rotatably supported by the support body such that a staple replacing portion included in the binding means faces an opening formed in the finisher.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
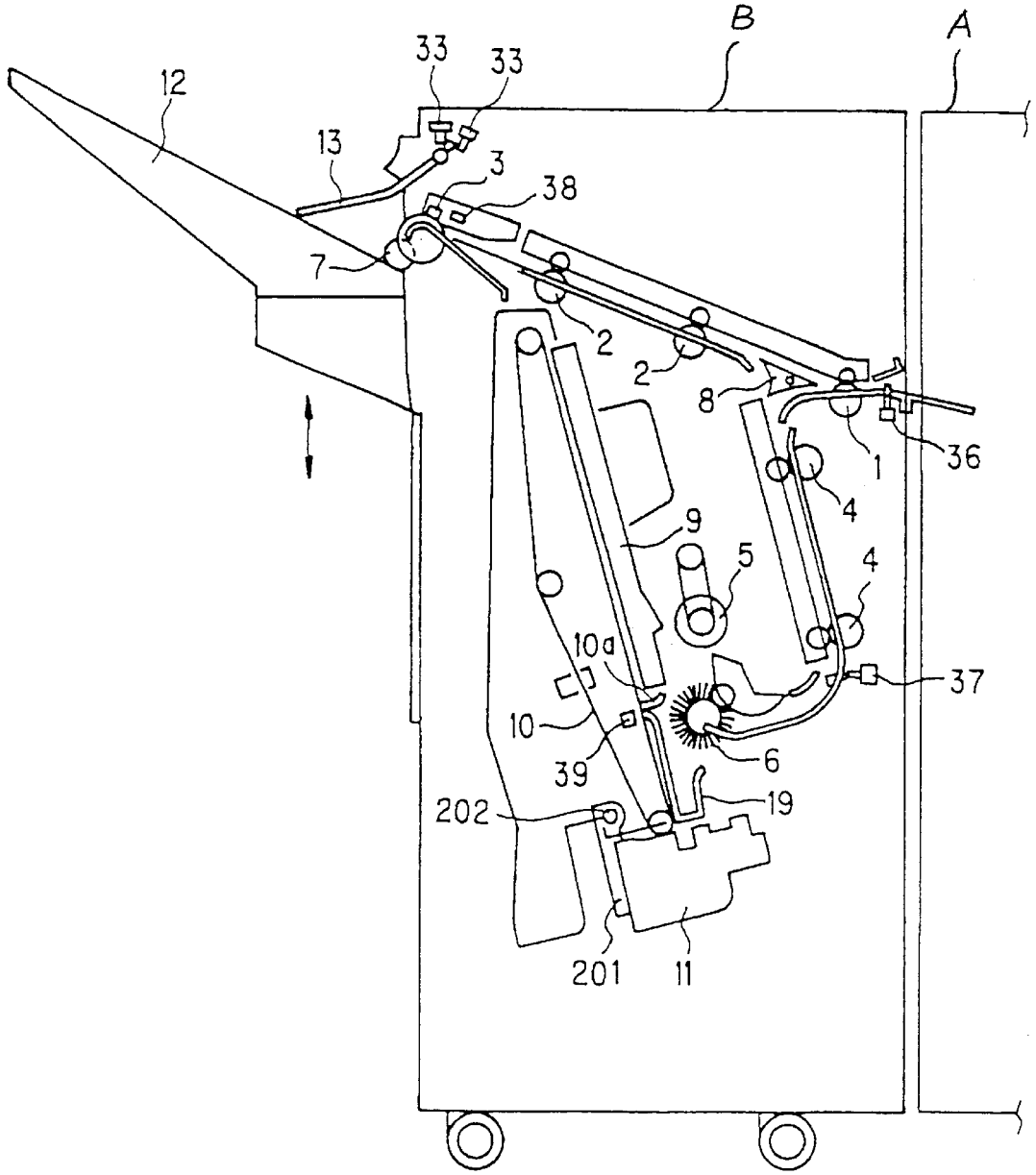
FIG. 1 is a view showing the general construction of a finisher embodying the present invention.

Referring to FIG. 1 of the drawings, a finisher embodying the present invention is shown and implemented as a binding device B operatively connected to a copier A, which is a specific form of an image forming apparatus. As shown, the binding device B includes an inlet for receiving papers sequentially driven out of the copier A. An inlet sensor 36, an inlet roller 1 and a path selector 8 are arranged in the vicinity the inlet. The path selector 8 selectively steers a paper coming in through the inlet to a copy tray 12 or a stapling unit 11.

A plurality of upper roller pairs 2 for conveying a paper, an outlet sensor 38, an outlet roller pair 3 and a put roller 7 for putting a paper to one side are arranged on a path extending from the path selector 8 to the copy tray 12. Also arranged on the above path are a lever 13 angularly movable in contact with the top paper or copy stacked on the copy tray 12, and height sensors 33 for determining the height or level of papers stacked on the copy tray 12. A plurality of lower roller pairs 4 for conveying a paper, a paper sensor 37 and a roller pair 6 are arranged on a path extending from the path selector 8 to the stapling unit 11. The roller pair 6 includes a brush roller 6 for conveying a paper toward the stapling unit 11. A conveyance motor 54 (see FIG. 5) drives the upper roller pairs 2 and lower roller pairs 4 while a discharge motor (see FIG. 5) drives the outlet roller pair 3 and put roller 7. An up/down motor 51 (see FIG. 5) causes the copy tray 12 to move upward or downward while a shift motor 52 (see FIG. 5) shifts it in the direction perpendicular to the direction of paper discharge.

A staple tray, not shown, is inclined such that its upstream end, or the trailing end side with respect to a paper, in the direction of paper transport is lower in level than the downstream end. The stapling unit 11 is mounted on the upstream end of the staple tray. A pair of jogger fences 9, a return roller 5 and a belt 10 are arranged on the staple tray. The jogger fences 9 are movable toward and away from each other in the direction perpendicular to the direction of paper conveyance for positioning a paper on the staple tray. Every time a paper is driven out by the roller pair 6, the return roller 5 is brought into contact with the paper in order to convey (move) it in the direction opposite to the direction of paper conveyance. As a result, the trailing edge of the paper is caused to abut against an end fence 19, which will be described later, and positioned thereby. The belt 10 is positioned behind the jogger fences 9 for discharging a stack of stapled papers. A hook 10*a* extends out from part of the belt 10. A home position sensor 39 is positioned between the opposite runs of the belt 10 for sensing the hook 10*a* brought to a home position. When the belt 10 is rotated counterclockwise, as viewed in FIG. 1, the hook 10*a* raises the trailing edge of a stack of papers stapled by the stapling unit 11 to the out let roller pair 3. The out let roller pair 3 conveys the stapled paper stack onto the copy tray 12. A belt motor 57 (see FIG. 5) drives the belt 10.

Figure 2:
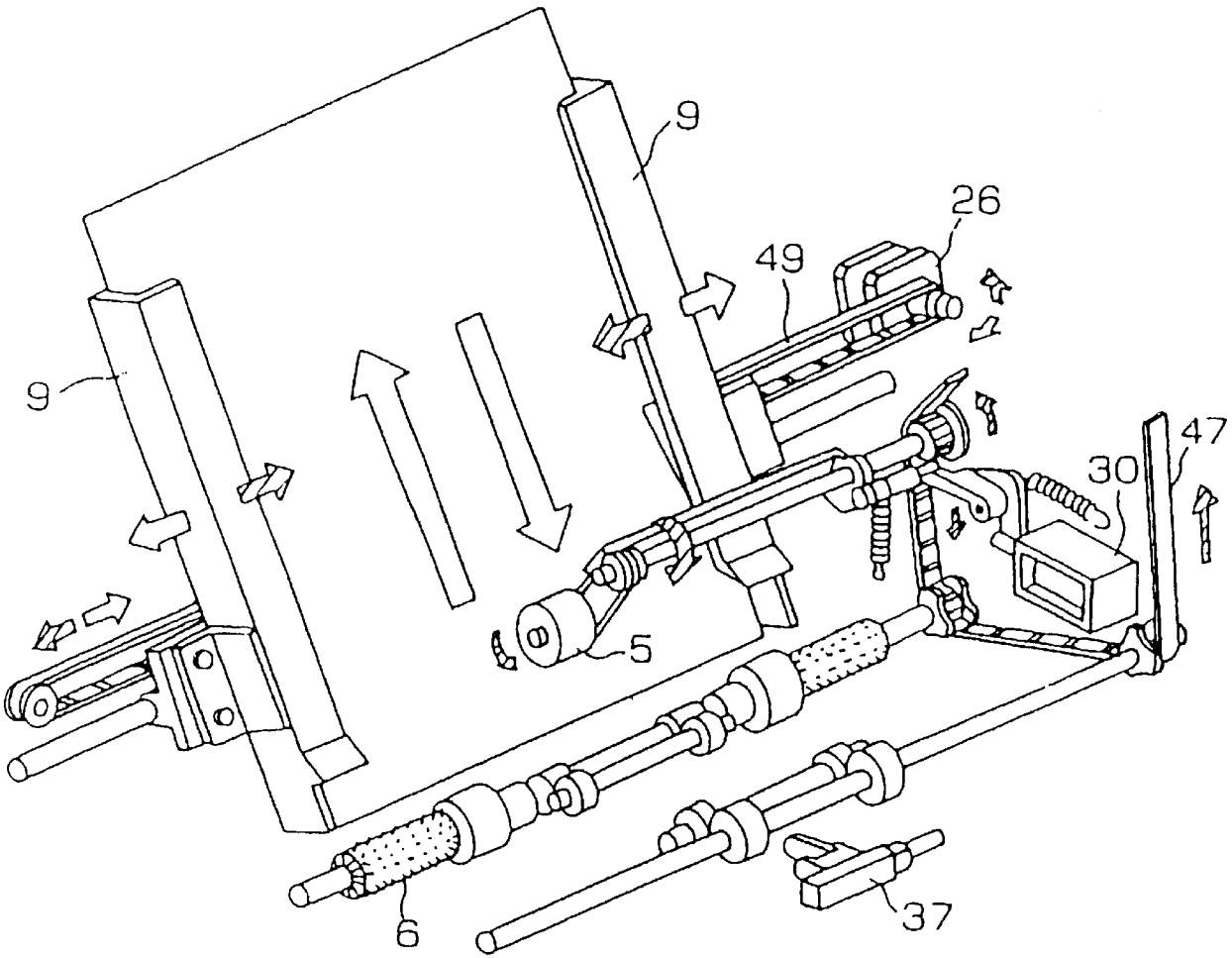
FIG. 2 is an isometric view showing a mechanism for driving jogger fences and a return roller included in the illustrative embodiment.
Figure 3:
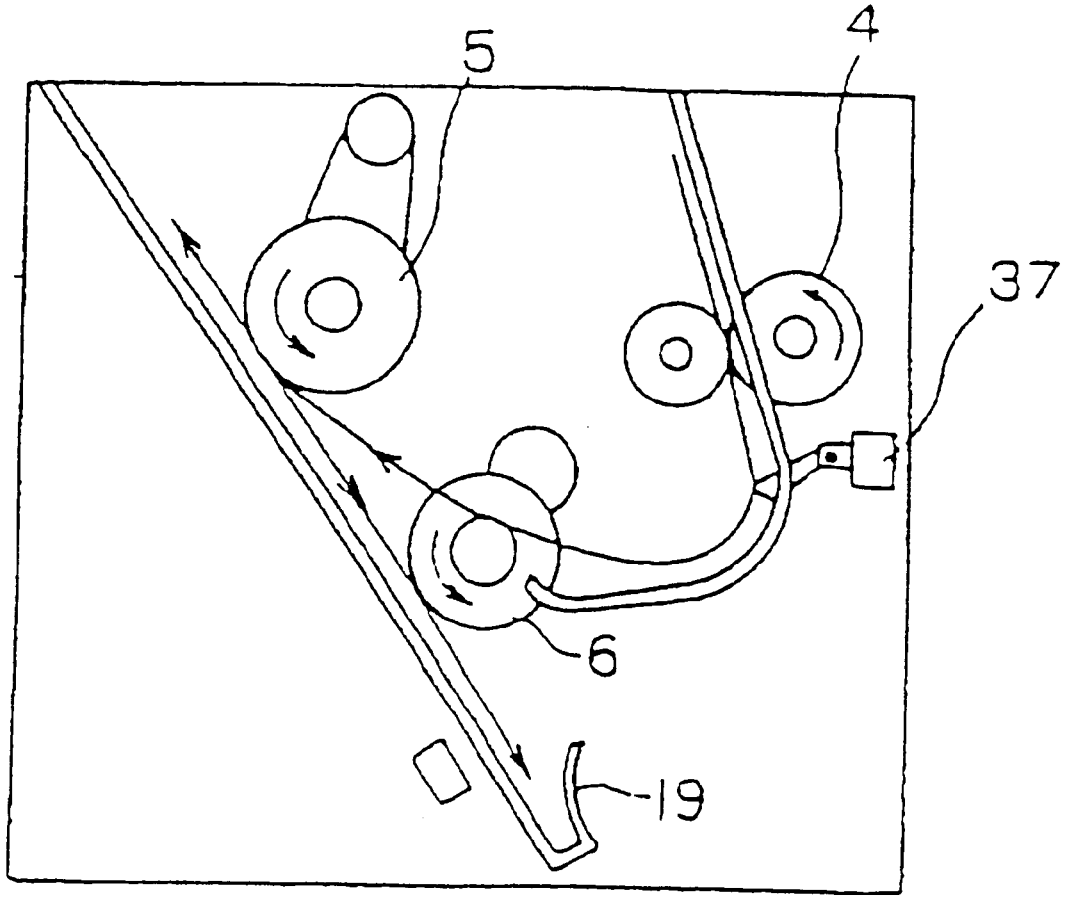
FIG. 3 is a view showing arrangements around a rear fence included in the illustrative embodiment.

As shown in FIG. 2, a reversible jogger motor 26 causes the jogger fences 9 to move toward and away from each other, i. e., perpendicularly to the direction of paper conveyance, as indicated by arrows. The conveyance motor 54 causes the return roller 5 to rotate counterclockwise, as indicated by an arrow in FIG. 3. In addition, a return solenoid 30 causes the return roller 5 to angularly move into and out of contact with a paper. A timing belt 47 causes the brush roller of the roller pair 6 to rotate in a direction indicated by an arrow in FIG. 3, so that the brush roller drives a paper onto the staple tray while guiding the trailing edge of the paper toward the rear fence 19. The rear fence 19 is positioned below the staple tray and jogger fences 9. As shown in FIG. 3, the rear fence 19 positions the paper when the trailing edge of the paper abuts against it.

Figure 4:
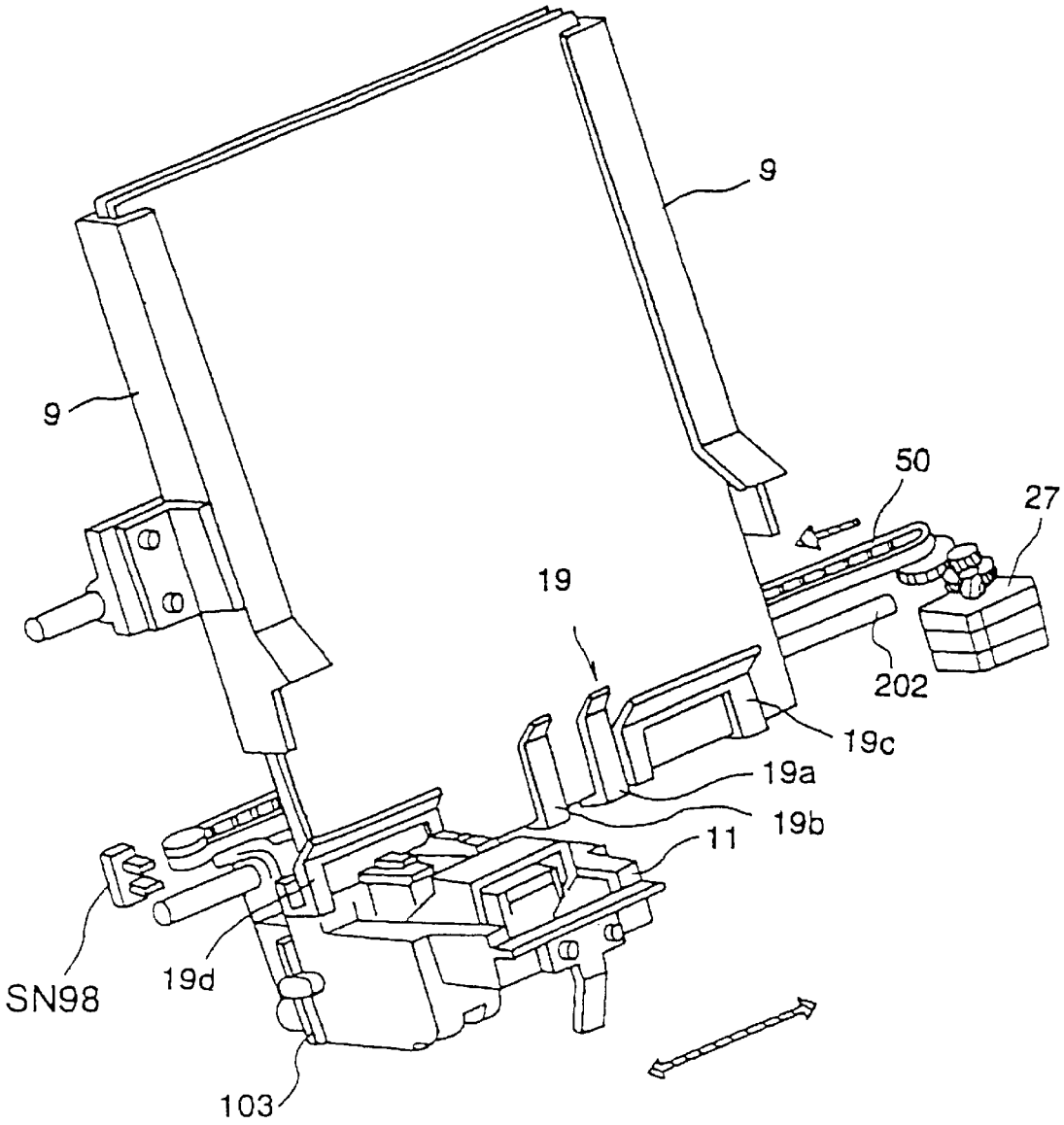
FIG. 4 is an isometric view showing a stapling unit included in the illustrative embodiment together with arrangements therearound.

As shown in FIG. 4, a reversible stapler motor 27 causes the stapling unit 11 to move via a belt 50 along the trailing edges of papers stacked on the staple tray, as indicated by an arrow (perpendicularly to the direction of paper conveyance). After the motor 27 has stopped the movement of the stapling unit 11 at a preselected position corresponding to a desired stapling position, a staple motor 56 (see FIG. 5) drives a staple or staples, not shown, stored in the stapling unit 11 into the paper stack. The above stapling position may be a front stapling position, a rear stapling position, an oblique stapling position or a two-point stapling position by way of example. The rear fence 19 includes stationary pieces 19*a* and 19*b* and movable pieces 19*c* and 19*d*. The movable pieces 19*c* and 19*d* each are engageable with a projection, not shown, protruding from the stapling unit 11 and suitably movable together with the stapling unit 11 in the direction indicated by the arrow in FIG. 4. Specifically, the movable piece 19*c* moves over a range rightward of the stationary piece 19*a* while the movable piece 19*d* moves over a range leftward of the stationary piece 19*b*. A stapler home position sensor SN98 is responsive to the home position of the stapling unit 11.

The paper sensor 37 is positioned such that even when the return solenoid 30 brings the return roller 5 into contact with a paper as soon as the paper sensor 37 senses the trailing edge of the paper, the trailing edge of the-paper has already moved away from the brush roller 6. For example, assume that it takes about 100 milliseconds for the return roller 5 to contact (press) a paper after the paper sensor 37 has sensed the trailing edge of the paper (ON), and that the paper is conveyed at a mean rate of 800 mm/sec. Then, the paper sensor 37 may be positioned 80 mm upstream of the brush roller or conveyor roller 6.

Figure 6:
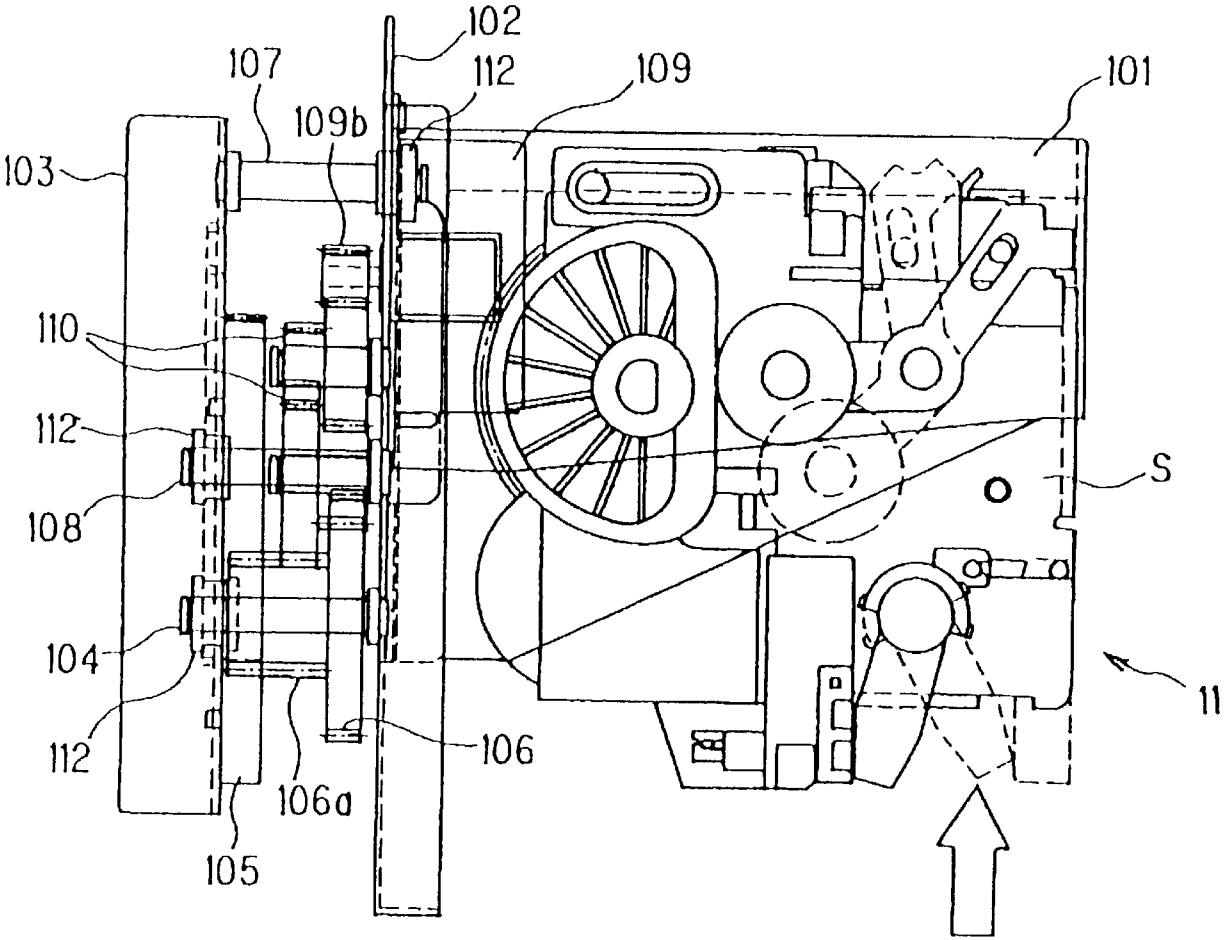
FIG. 6 is a partly omitted front view of the stapling unit.
Figure 7:
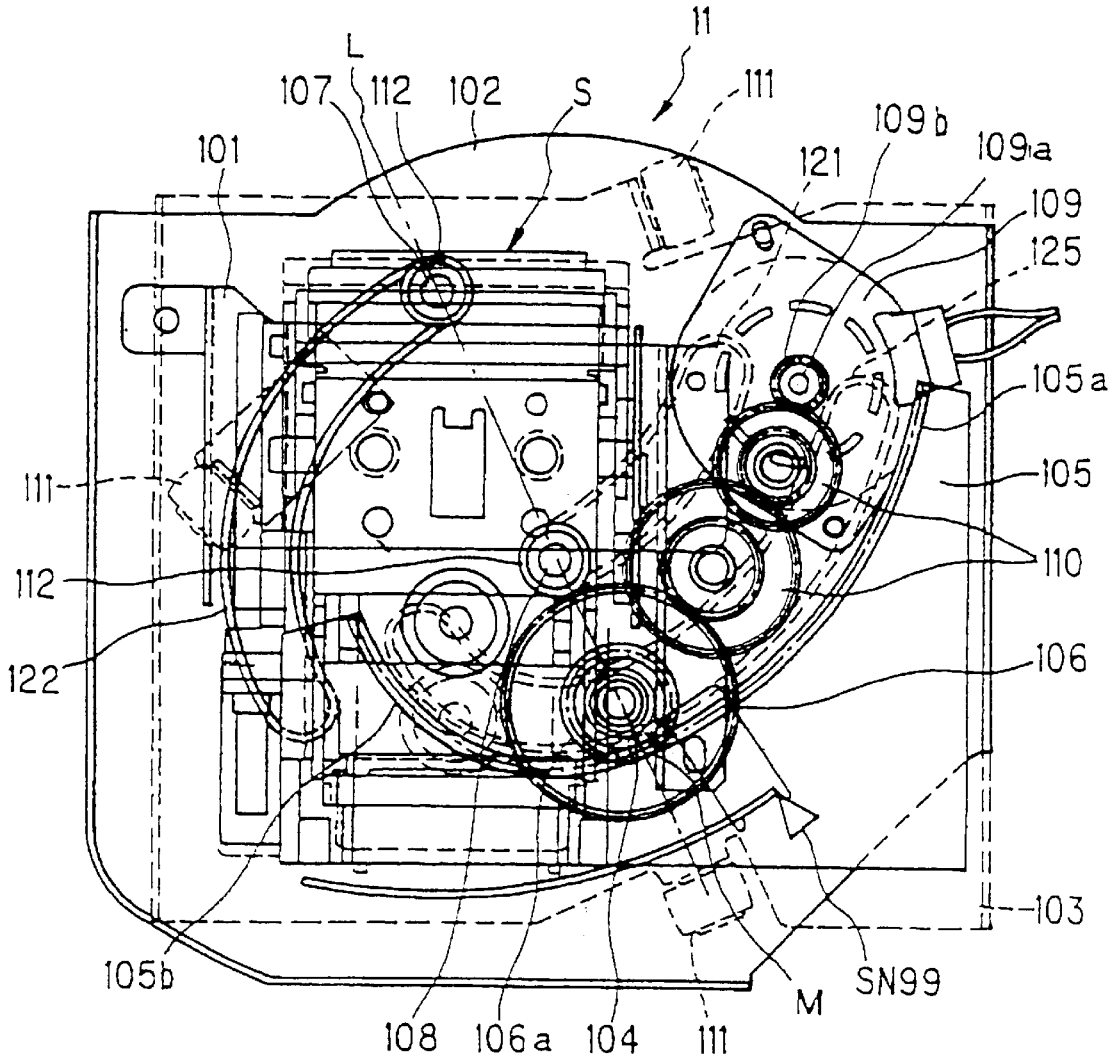
FIG. 7 is a side elevation of the stapling unit.
Figure 11:
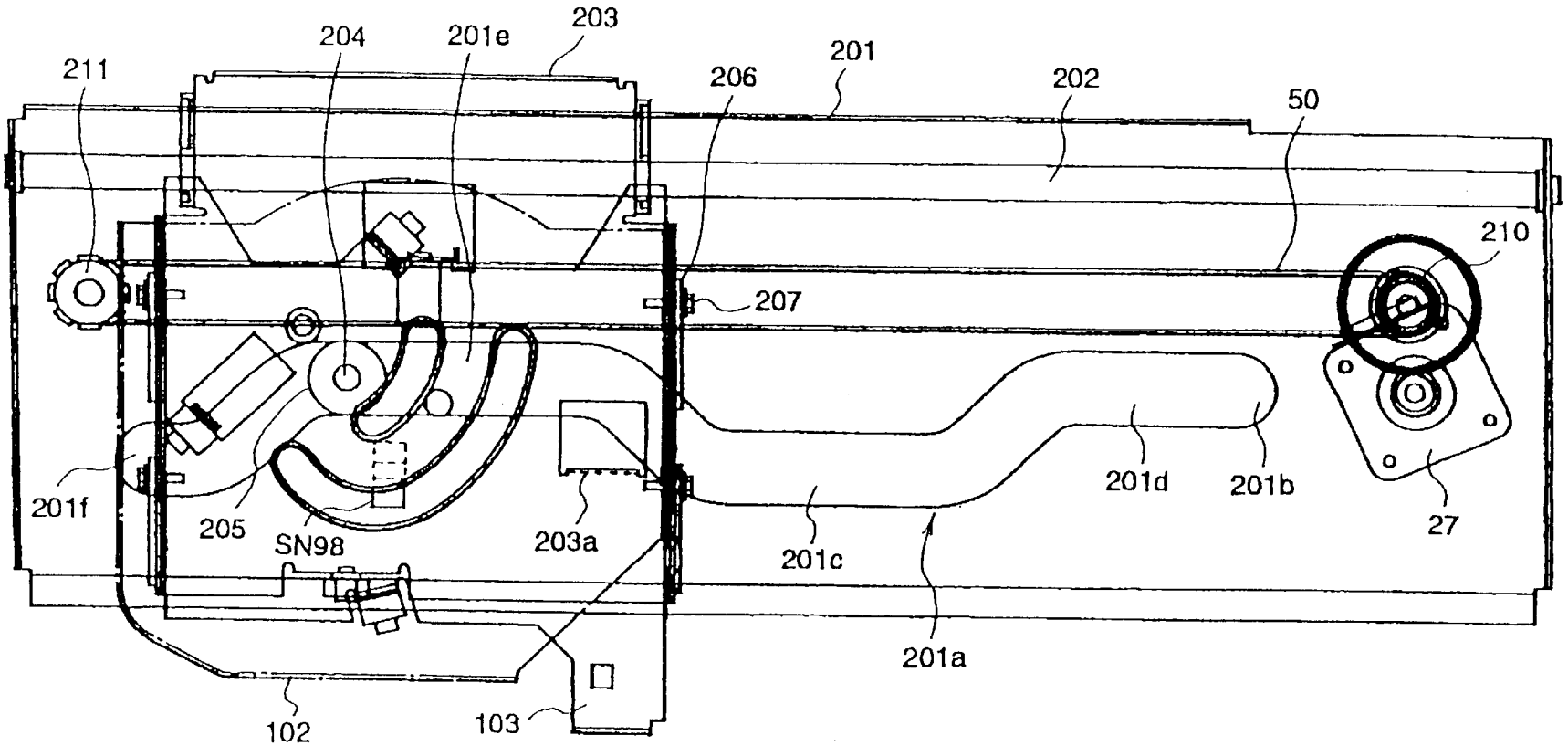
FIG. 11 is a front view showing a mechanism for moving the stapler in the horizontal direction.

As shown in FIGS. 6 and 7, the stapling unit 11 includes a stapler S supported by a bracket 101. The bracket 101 is affixed to the inner surface of a flat slider 102. A base 103 has an inner surface facing the outer surface of the slider 102 at a preselected distance. As shown in FIG. 11, the base 103 is mounted on a carriage 203 that is, in turn, suspended from a guide rod 202 affixed to a slide rate 201. The carriage 203 is affixed to a timing belt 50 passed over a pair of pulleys 210 and 211. The stapler motor 27 drives one pulley 210 so as to move the carriage 203 via the timing belt 50. When the carriage 203 is brought to a home position, a feeler 203*a* mounted on the carriage 203 turns off the previously mentioned home position sensor SN98.

Figure 12:
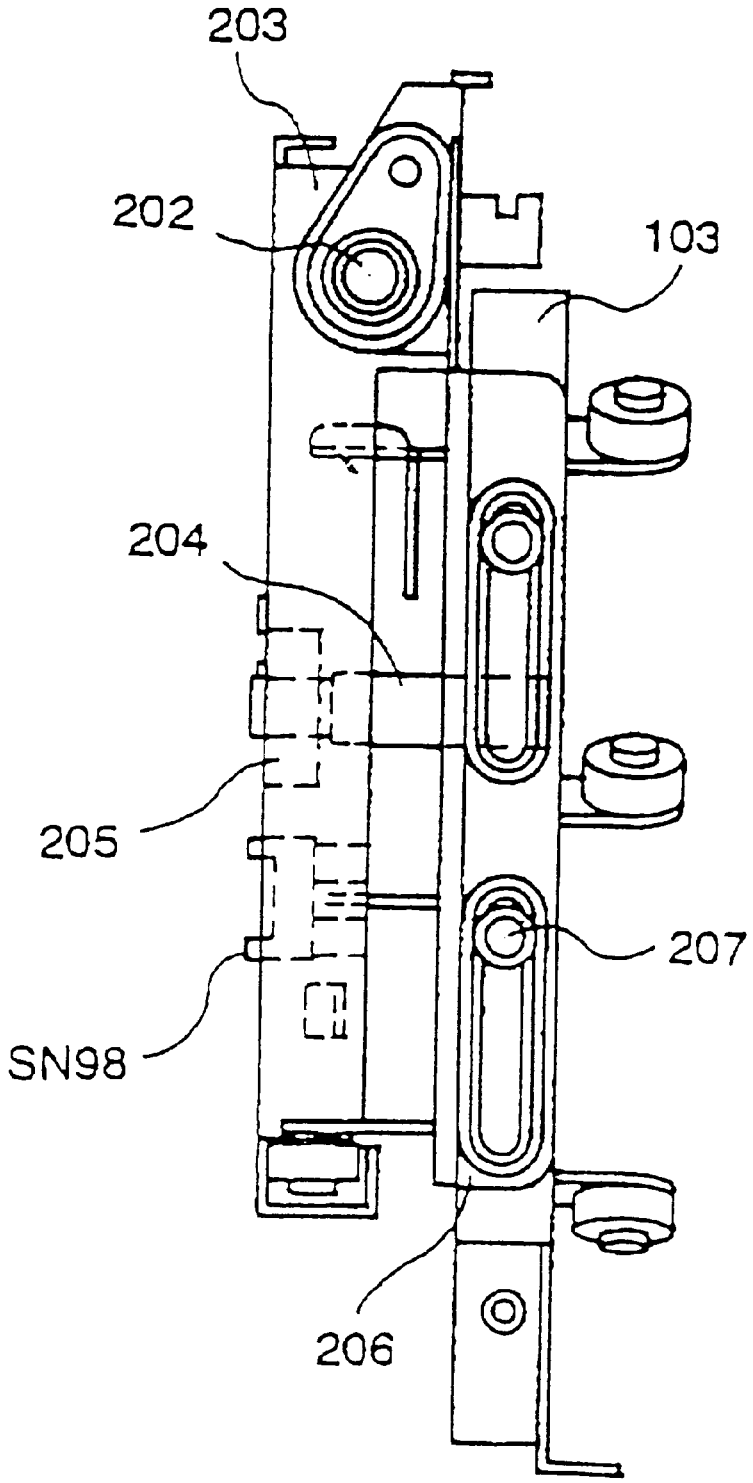
FIG. 12 is a side elevation of the mechanism shown in FIG. 11.

As also shown in FIG. 12, the base 103 is connected to the carriage 207 via guides 206 and stepped screws 207 in such a manner as to be movable over the length of each guide 206. The slide rail 201 is formed with a cam 201*a*. A shaft 204 protrudes from the base 103 and extends throughout the carriage 203. A roller 205 is rotatably mounted on the shaft 204. The shaft 204 and roller 205 are movably received in the cam 201*a*, so that the roller 205 is movable a along the cam 201*a* while being regulated by the cam 201*a*. In this condition, when the carriage 203 moves along the guide rod 202 due to the forward/reverse rotation of the stapler motor 27, the base 103 moves not only in the horizontal direction but also in the vertical direction, as viewed in FIG. 11, in accordance with the configuration of the cam 201*a*. During movement in the vertical direction, the base 103 moves toward or away from a paper.

The slide rail 201 and guide rod 202 have a positional relation shown in FIGS. 1 and 4. Therefore, while the stapling unit 11 moves from the front side to the rear side along the cam 201*a*, it is lowered even below the bottom of the staple tray at the intermediate portion 201*c* of the cam 201*a* so as not to interfere with the hook 10*a* of the belt 10. A front position 201*f* where the stapling unit 11 is lowered is the home position of the stapling unit 11. A rear position 201*b* is a stapling position where the stapling unit 11 drives a single staple into the rear corner of a paper stack or drives it obliquely into the paper stack.

A rotation motor 109 is mounted on the inner surface of the slider 102 for rotating the bracket 101, i.e., the slider 102 such that the stapler S is rotatable relative to a paper stack by 90° or 45°. The rotation motor 109 is implemented by a reversible stepping motor. The rotation motor 109 has an output shaft 109*a* protruding from the outer surface of the slider 102. A drive gear 109*b* is mounted on the outermost end of the output shaft 109*a*. Also mounted on the outer surface of the slider 102 are a gear train 110 held in mesh with the drive gear 109*b* and a pinion gear 106 having a gear 106 at its bottom. The gear 106 is held in mesh with the last gear of the gear train 110. The gear 106 and pinion gear 106*a* are rotatably supported by a pinion shaft 104 while a guide pulley 112 is rotatably mounted on the end of the pinion shaft 104. The base 103 positioned outward of the slider 102 is formed with an elongate slot 125 that will be described specifically later. The guide pulley 112 is movably received in the slot 125.

A first center shaft 108 is affixed to substantially the center of the outer surface of the slider 102 at one end thereof. The stapler S is rotatable clockwise by 90° about the first center shaft 108. A guide pulley 112 is rotatably mounted on the other end of the first center shaft 108 and movably received in a slot 121, which will be described later, formed in the base 103. A second center shaft 107 is affixed to the inner surface of the base 103 at one end thereof and allows the stapler S to rotate counterclockwise by 45° thereabout. A guide pulley 112 is rotatably mounted on the other end of the second center shaft 107 and movably received in a slot 122, which will be described later, formed in the slider 102. The slot 121 has a configuration corresponding to an arcuate locus that the stapler S forms when rotating counterclockwise by 45° about the second center shaft 107. The slot 122 has a configuration corresponding to an arcuate locus that the stapler S forms when rotating clockwise by 90° about the first center shaft 108.

Three rollers 111, indicated by dotted lines in FIG. 7, are rotatably mounted on the inner surface of the base 103. The rollers 111 maintain the slider 102 and base 103 spaced from each other and allow the slider 102 to easily rotate. A rack plate 105 is affixed to the inner surface of the base 103 and formed with racks 105*a* and 105 capable of meshing with the pinion gear 106*a*. The pinion gear 106*a* is movable along the racks 105*a* and 105*b*, so that the slider 102 and therefore the stapler S can rotate. The racks 105*a* and 105*b* are implemented as two arcs smoothly merging into each other, but different in diameter from each other. An inflection point M between the two arcs is positioned on an imaginary line L connecting the first and second center shafts 108 and 107. Further, a rotation home position sensor SN99 is mounted on the inner surface of the base 103 for sensing the slider 102 brought to its home position shown in FIG. 7.

The rotation home position sensor SN99 turns on when the pinion gear 106*a* is engaged with the rack 105*a*, but turns off when it is engaged with the other rack 105*b*. The angular homing of the stapler S is therefore effected on the basis of the output of the rotation home position sensor SN99, as will be described later with reference to FIG. 18. If the sensor SN99 is in an OFF state, the stapler S is rotated counterclockwise until the sensor SN99 turns ON. Subsequently, the stapler S is rotated clockwise until the sensor SN99 turns off. On the other hand, if the sensor SN99 is in an ON state, the stapler S is rotated clockwise until the sensor SN99 turns off. By such a procedure, the home position of the stapler S with respect to rotation is determined.

Figure 8:
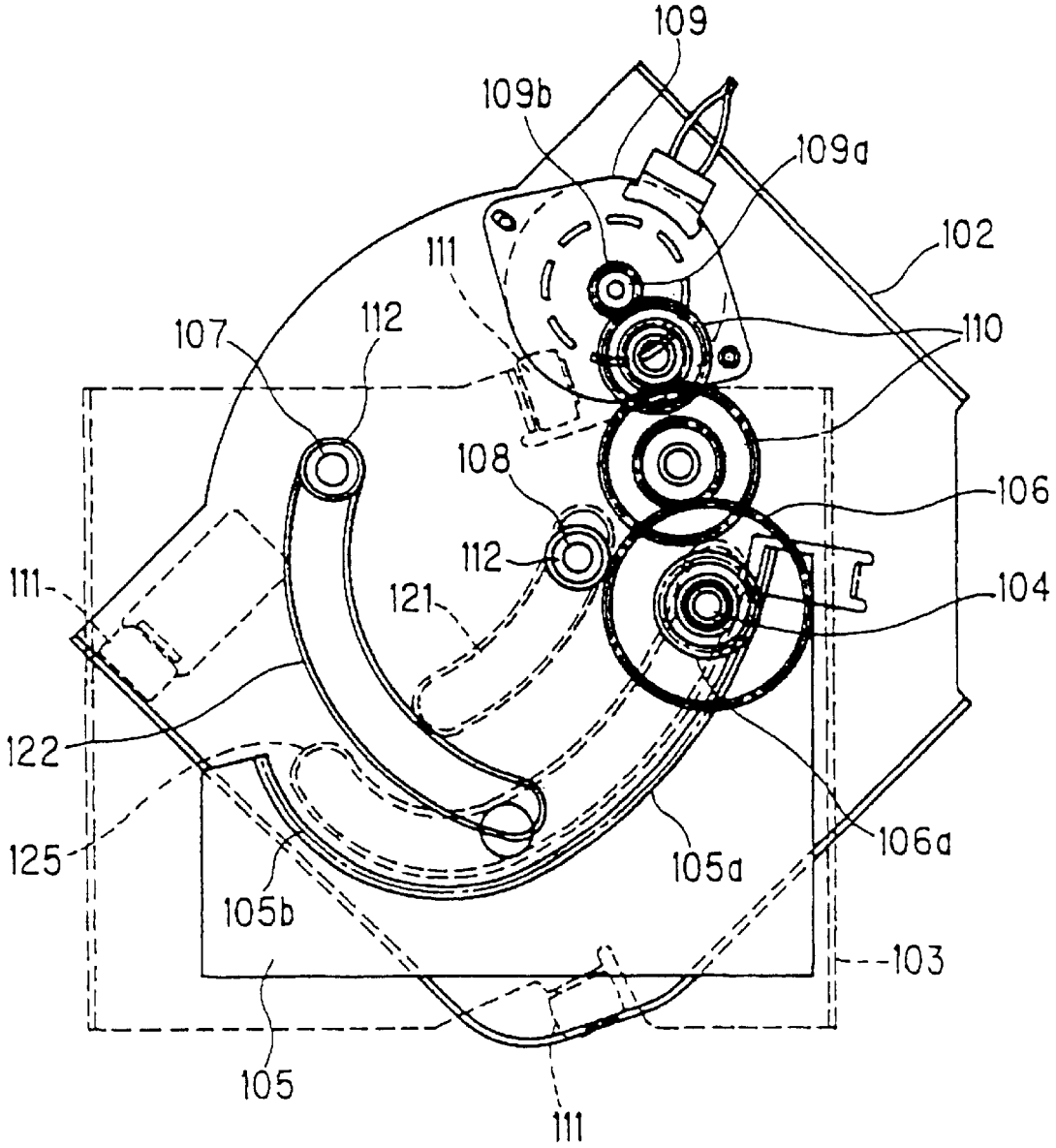
FIG. 8 is a view showing a stapler included in the stapling unit and rotated counterclockwise from a preselected position by 45°.
Figure 15:
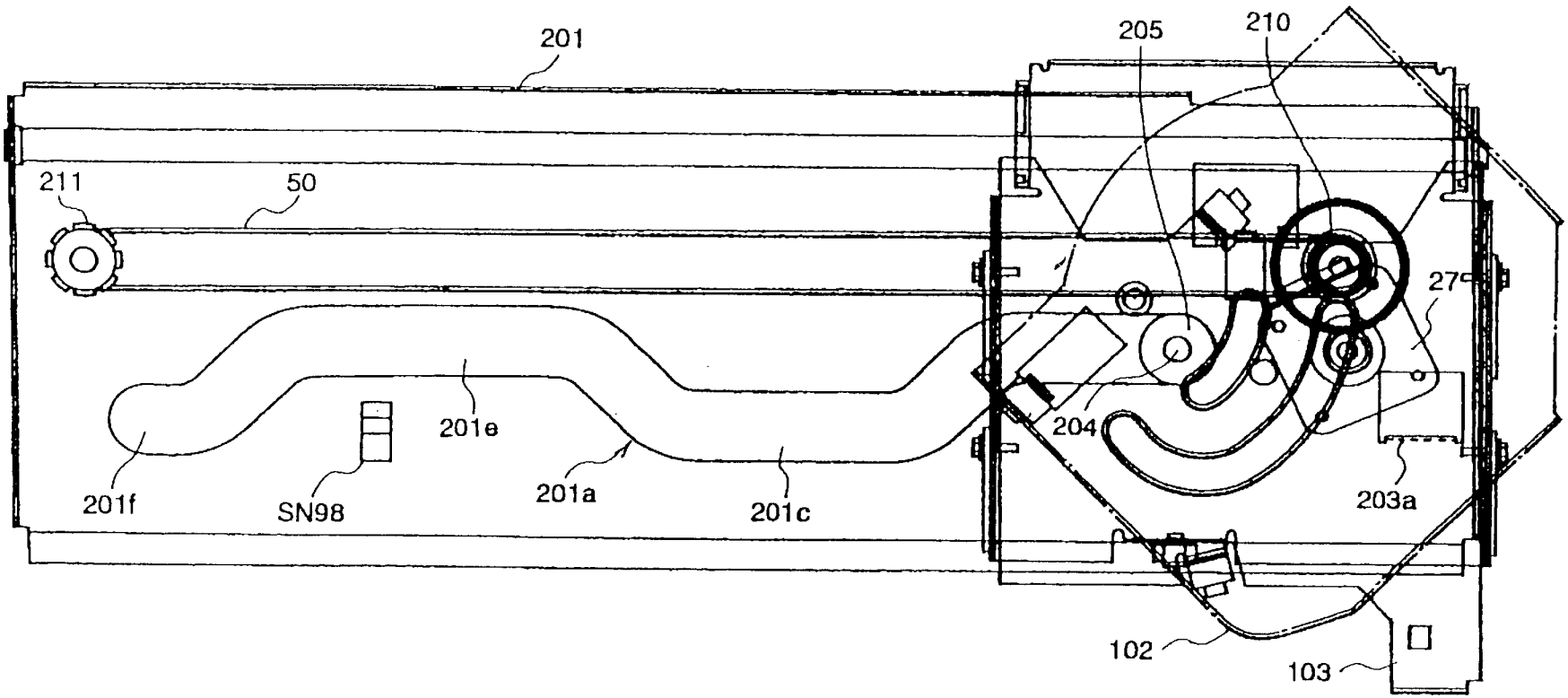
FIG. 15 is a front view showing the stapler located at an oblique stapling position.

Assume that the rotation home position sensor SN99 determines that the slider 102 is located at its home position while the stapler home position sensor SN98 determines that the carriage 203 is located at its home position on the slide rail 201, i.e., the stapler S is located at its home position. Then, to drive a stapler obliquely into a paper stack, the stapler S is moved to the rear position 201*b*, FIG. 11, (see FIG. 15 also) and then rotated counterclockwise by 45°. More specifically, the stapler motor 27 is driven to move the carriage 203 to the rear position 201*b*. Subsequently, the rotation motor 109 is driven to rotate the pinion gear 106*a* counterclockwise until it meshes with the rack 105*a* of the rack plate 105. As a result, the slider 102 is caused to rotate counterclockwise about the second center shaft 107 by 45°, as shown in FIG. 8. In parallel with the rotation of the slider 102, the first center shaft 108 moves from one end to the other end of the slot 121, supporting the rotation of the slider 102.

Figure 9:
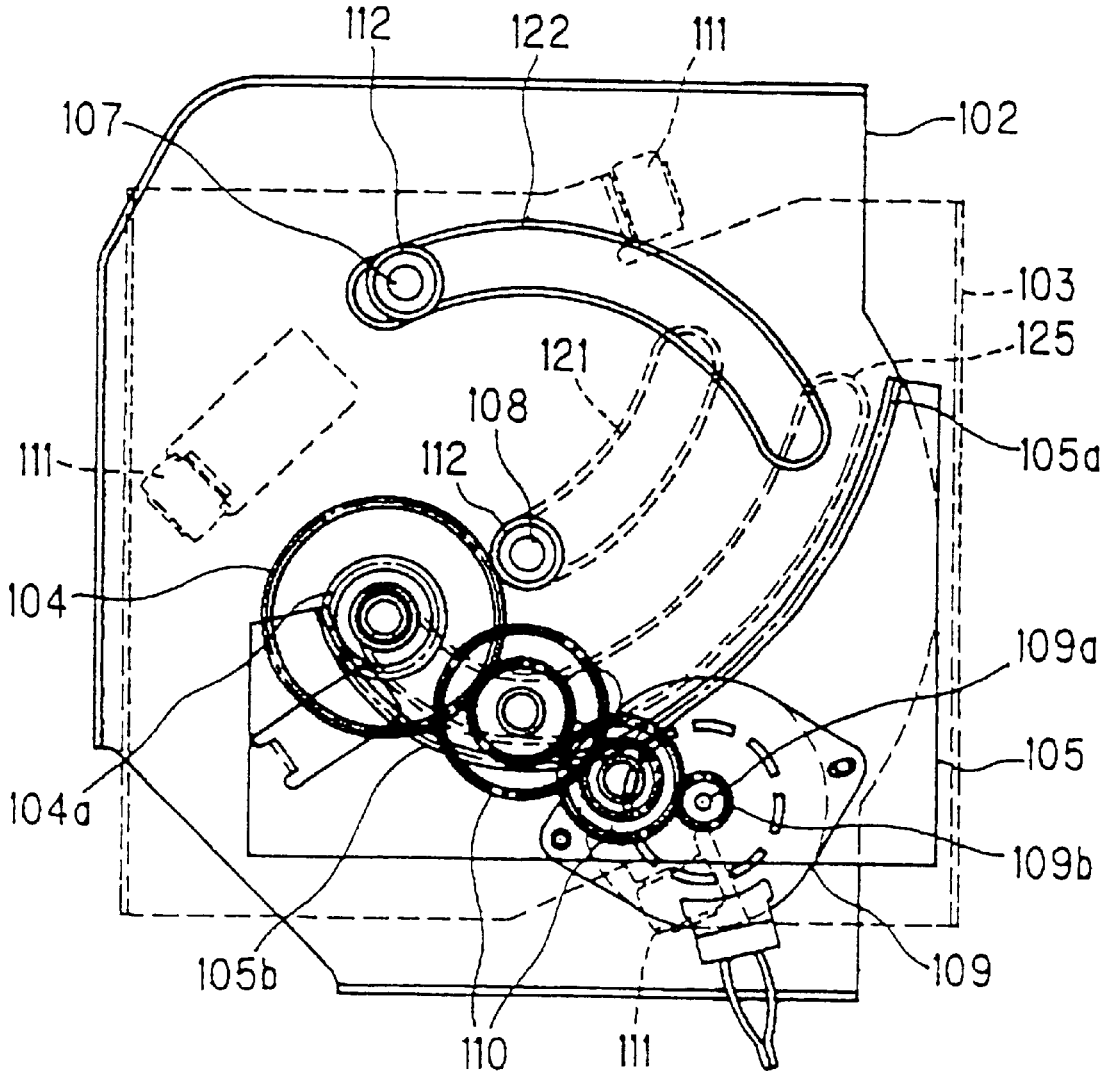
FIG. 9 is a view showing the stapler rotated clockwise from the preselected position by 90°.

To replenish staples to the stapler S, the stapler S located at the front position or home position 201*f* shown in FIG. 11, i.e., the slider 102 is rotated clockwise by 90°. Specifically, the rotation motor 109 is driven in the reverse direction to rotate the pinion gear 106*a* clockwise into mesh with the rack 105*b* of the rack plate 105. As a result, the slider 102 rotates clockwise about the first center shaft 108, as shown in FIG. 9. At this instant, the second center shaft 107 moves from one end to the other end of the slot 122, supporting the rotation of the slider 102.

The carriage 203 loaded with the base 103 moves along the trailing edge of a paper stack positioned on the staple tray (or the lower end of the staple tray) in order to move the stapler S, as stated earlier. The stapler S brought to the rear position or stapling position 201*b* may be rotated by 450° in order to staple the paper stack obliquely or may not be rotated in order to staple it horizontally. Further, the stapler S may staple the paper stack in parallel at two spaced positions 201*d* and 201*e* also included in the cam 201*a* and protruding toward the paper stack.

Figure 10:
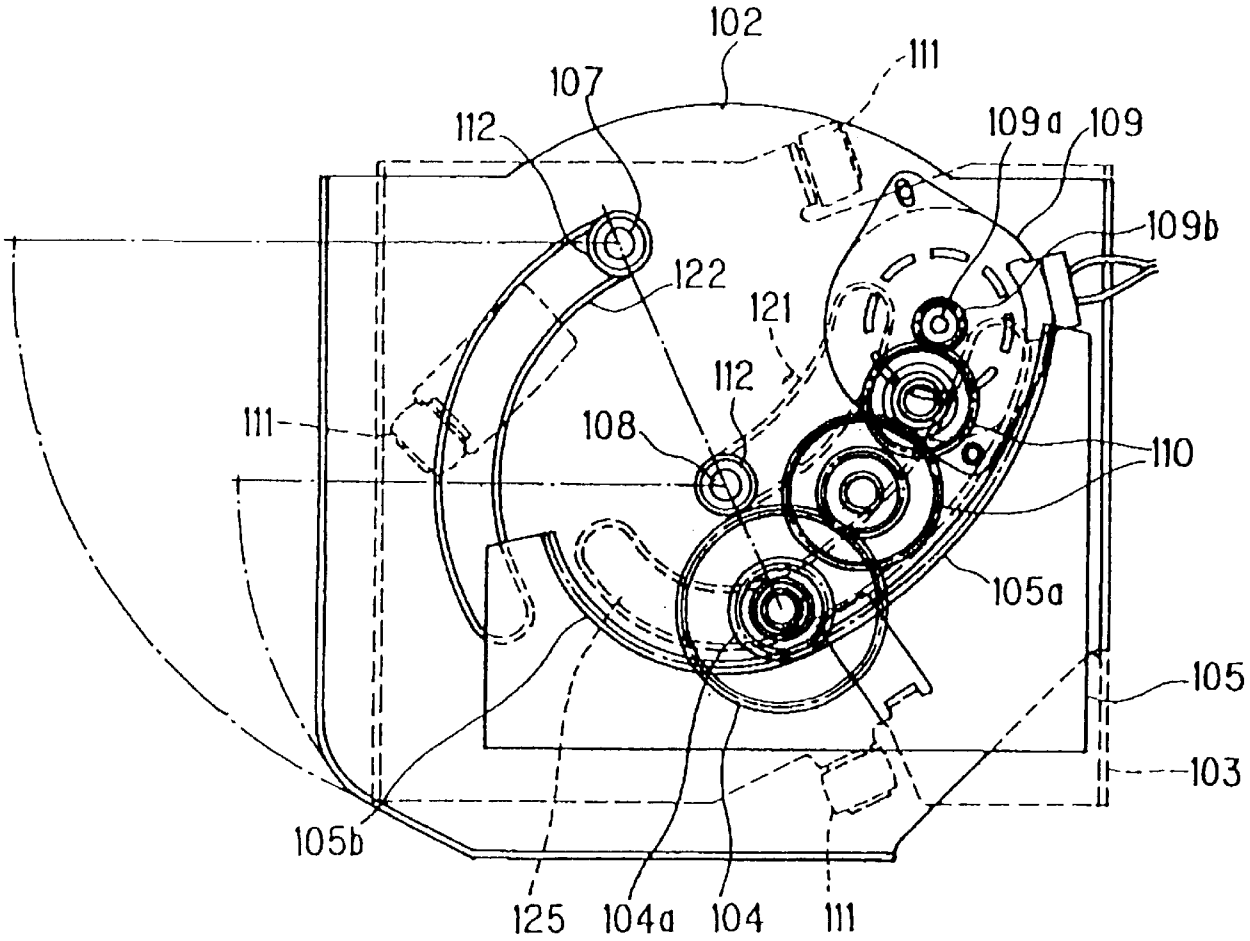
FIG. 10 is a view for describing a case wherein the fulcrum of rotation of a slider included in the stapling unit is switched in accordance with the angle of rotation and a case wherein it is not switched.

An opening formed in the stapler S for the replenishment of staples is usually directed downward, as indicated by an arrow in FIG. 6. When the stapler S, i. e., the slider 102 is rotated clockwise by 90°, the above opening is oriented substantially horizontally and aligns with an opening formed in the finisher. More specifically, when the slider 102 is rotated clockwise by 90°, the opening of the stapler S faces the front of the binding device B. In this position, the operator can easily replenish staples to the stapler S by opening a cover, not shown, covering the opening of the finisher. Switching the fulcrum of rotation in accordance with the angle of rotation, i.e., 45° or 90° is successful to reduce the overall size of the finisher, as stated earlier. If the fulcrum of rotation is not switched, then the slider 102 must be rotated as indicated by a dash-and-dot line in FIG. 10, effecting the overall size of the finisher to a noticeable degree.

Figure 5:
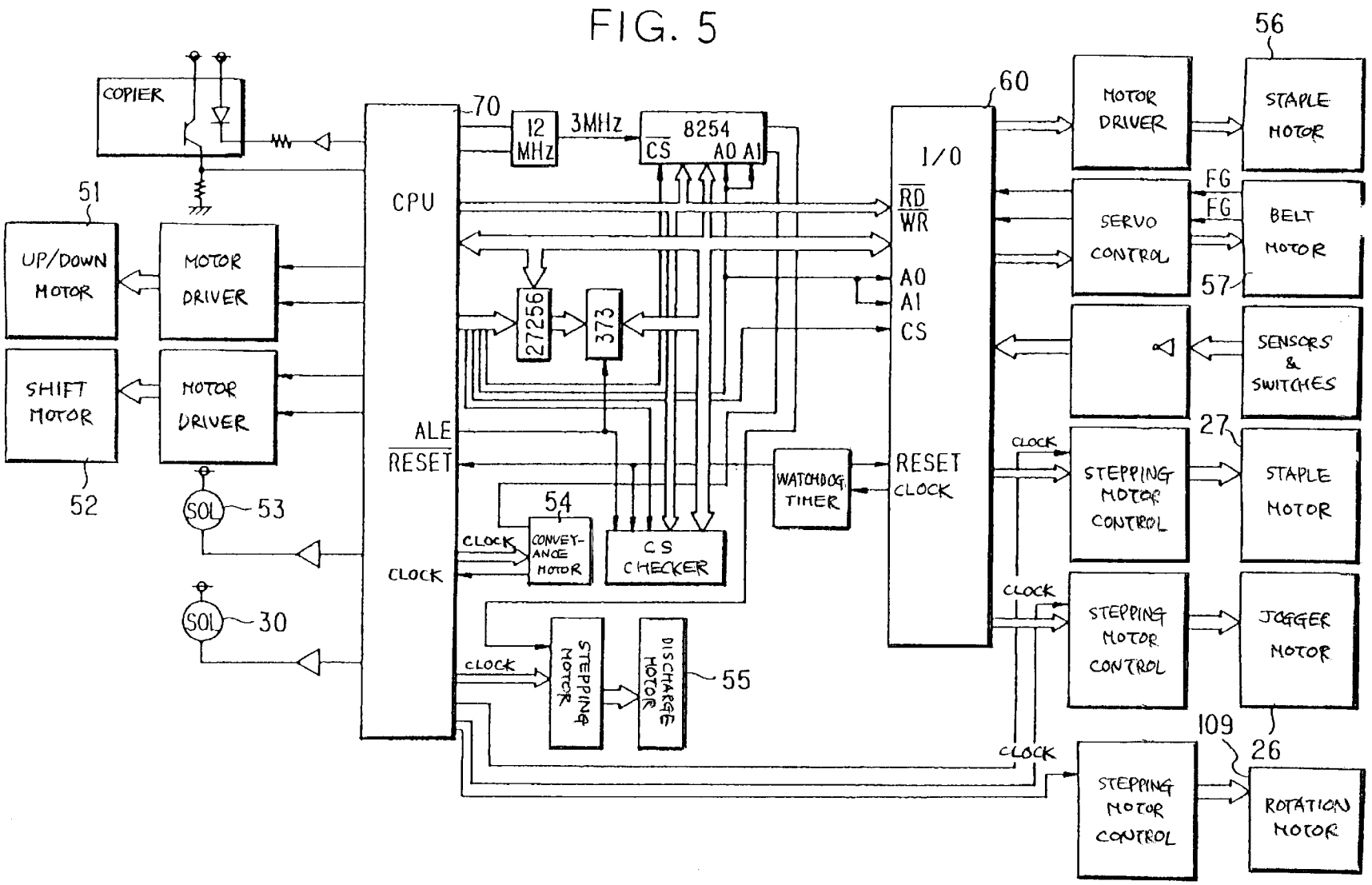
FIG. 5 is a block diagram schematically showing a control system included in the illustrative embodiment.

Referring to FIG. 5, a control system particular to the illustrative embodiment includes a CPU (Central Processing Unit) 70 receiving the outputs of various switches and sensors via an I/O (Input/Output) interface 60. The CPU 70 controls, based on the input signals, the reversible up/down motor 51, reversible shift motor 52, return solenoid 30, conveyance motor 54, staple motor 56, belt motor 57, reversible stapler motor 27, reversible jogger motor 26 and reversible rotation motor 109 as well as a branch solenoid 53 and a discharge motor 55. Specifically, the CPU 70 counts pulse signals output from the conveyance motor 54 and controls the return solenoid 30 on the basis of the count. Further, the CPU 70 constitutes paper position control means in combination with various operation programs for causing the CPU 70 to operate.

The operation of the above finisher will be described hereinafter. First, assume that the operator selects a non-staple mode in which the finisher does not staple papers. In this mode operation, a paper or copy driven out of the copier A is received by the inlet roller 1, then conveyed by the upper roller pairs 2, and then driven out to the copy tray 12 by the outlet roller pair 3. On the copy tray 12, the put roller 7 puts the paper to one side and thereby neatly positions it in the vertical direction. As soon as the outlet sensor 38 senses the trailing edge of the above paper, the outlet roller pair 3 is decelerated in order to promote neat stacking of the paper. As papers driven out of the copier A one by one are sequentially stacked on the copy tray 12, they raise the lever 13, i.e., angularly move it clockwise. When the height sensors 33 sense the lever 13, the up/down motor 51 is driven to lower the copy tray 12. In this manner, the copy tray 12 is always maintained at an adequate height or level. Assume that the operator selects a sort mode or a stack mode on a control panel, not shown, mounted on the top of the copier A. Then, the shift motor 52 shifts the copy tray 12 in the direction perpendicular to the direction of paper discharge in response to a signal output from a CPU built in the copier A, so that papers are sorted or stacked until the end of a job.

Assume that the operator selects a front staple, rear staple, oblique staple, two-point staple or similar staple mode on the control panel of the copier A. Then, as shown in FIG. 2, the jogger fences 9 are moved away from each other, i.e., away from their home positions, and each is stopped at a distance of 7 mm from one side edge of a paper. The conveyance motor 54 causes the lower roller pairs 4 to convey a paper. When the trailing edge of the paper moves away from the paper sensor 37, each jogger fence 9 is moved toward the other jogger fence 9 by 5 mm. On the elapse of a preselected period of time, the return solenoid 30 is turned on.

The return roller 5 swings back and forth in accordance with the turn-on and turn-off of the return solenoid 30. Specifically, when the return solenoid 30 is turned on, the return roller 5 is pressed against a paper and returns it in the direction opposite to the direction of paper conveyance until the paper abuts against the rear fence 19. As a result the paper is positioned by the rear fence 19 in the direction of paper conveyance, i.e., in the vertical direction. Every time a paper moves away from the inlet sensor 36 or the paper sensor 37, the sensor 36 or 37 sends its output to the CPU 70. On the elapse of a preselected period of time since the turn-off of the return solenoid 30, the jogger motor 26 moves the jogger fences 9 toward each other by 2.6 mm and then stops them, thereby positioning the paper in the direction perpendicular to the direction of paper conveyance. Subsequently, the jogger motor 26 moves the jogger fences 9 away from each other by 7.6 mm and causes them to wait for the next paper. The above procedure is repeated up to the last page. After the last page has been positioned, the jogger motor 26 again moves the jogger fences 9 toward each other by 7 mm and causes them to retain the opposite side edges of the paper stack until a stapling operation begins.

On the other hand, when the operator selects the staple mode on the control panel and then touches a copy start key on the control panel, the copier A sends various signals including a mode signal, a size signal and a staple mode signal to the binding device B. In response, the binding device B first determines whether a paper stack should be stapled at one point or at two points. The device B then causes the stapler motor 27 to move the stapler S to a position matching the paper size and the kind of stapling in the direction indicated by the arrow. Subsequently, the device B determines whether a staple should be driven into a paper stack in a horizontal mode or in an oblique mode. In the oblique mode, the device B rotates the stapler S counterclockwise by 45°. When the job fully completes, the device B drives the rotation motor 109 to rotate the stapler S clockwise and then stops driving the motor 109 when the rotation home position sensor SN99 turns off after turning on. Thereafter, the device B drives the stapler motor 27 to return the stapler S to the home position HP shown in FIG. 13.

Figure 16:
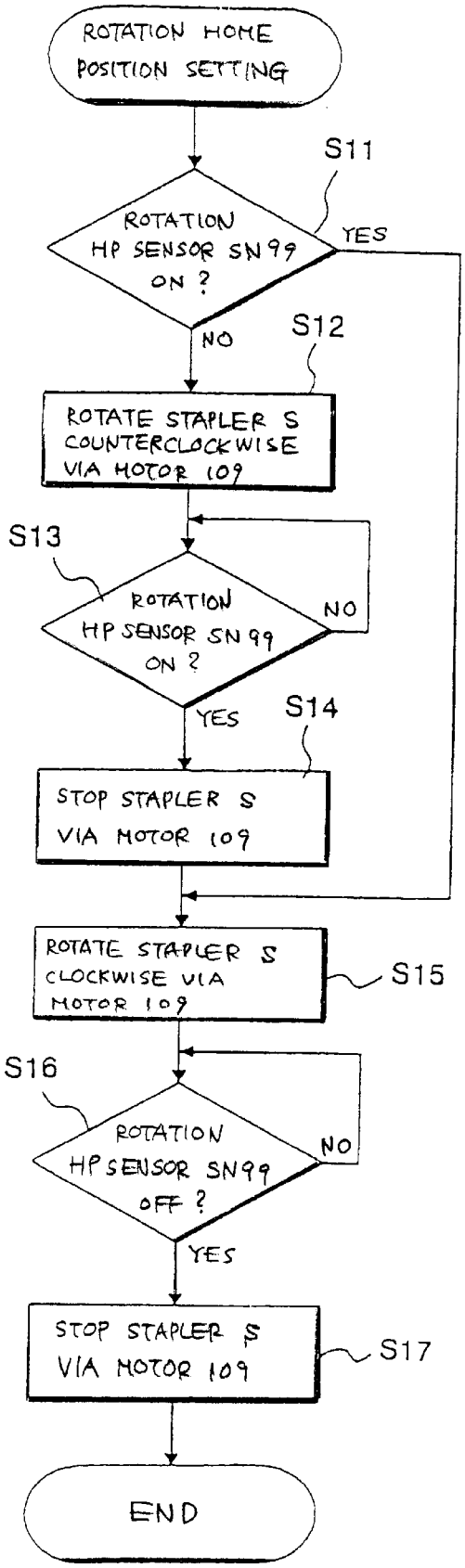
FIG. 16 is a flowchart demonstrating a procedure for rotating the stapler and returning it to the home position.

The angular position of the stapler S cannot be controlled unless its home position with respect to rotation is determined, i.e., unless the stapler S located at the home position or unless the position of the stapler S is recognized. Reference will be made to FIG. 16 for describing a procedure for rotating the stapler S and returning it to its home position. As shown, the CPU 70 determines whether or not the rotation home position sensor SN99 is in an ON state (step S11). If the sensor SN99 is in an OFF state (NO, step S11), the CPU 70 drives the rotation motor 109 in order to rotate the stapler S counterclockwise (step S12). The CPU 70 again determines whether or not the sensor SN99 has turned on (step S13), and returns to the step S13 if the answer of the step S13 is NO. If the sensor SN99 has turned on (YES, step S13), the CPU 70 stops driving the rotation motor 109 and therefore the rotation of the stapler S (step S14). Subsequently, the CPU 70 rotates the stapler S clockwise (step S15) and determines whether or not the sensor SN99 has turned off (step S16). If the answer of the step S16 is YES, the CPU 70 stop driving the rotation motor 109 and therefore the rotation of the stapler S (step S17). If the answer of the step S11 is YES, the CPU 70 executes the step S15, skipping the steps S12 through S14.

Figure 17:
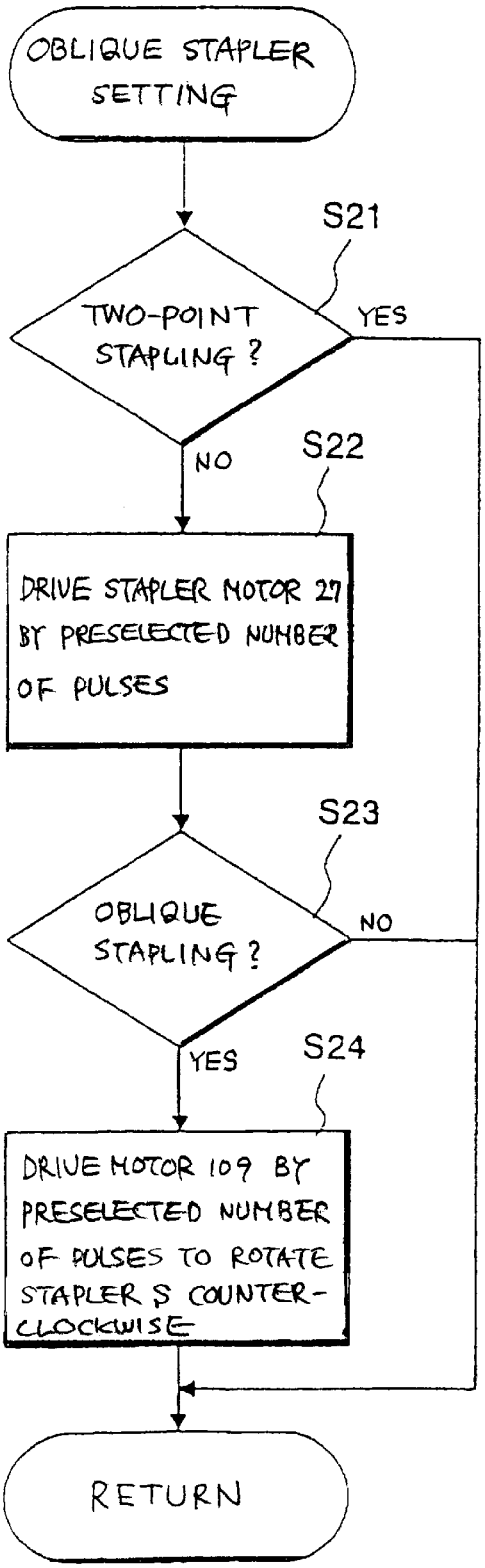
FIG. 17 is a flowchart showing a procedure for preparing the stapler for oblique stapling.

After the home position with respect to rotation has been determined by the above procedure, the finisher is capable of performing oblique stapling stated earlier. FIG. 17 shows an oblique stapler setting procedure more specifically. As shown, in response to a staple command, the CPU 70 determines whether or not a paper stack should be stapled at two points (step S21). If the answer of the step S21 is NO, the CPU drives the stapler motor 27 by a preselected number of pulses in order to move the stapler S to the rear (step S22). As a result, the stapler S is moved from the home position shown in FIG. 13 (the base 103 is located at the position 201*f* of the cam 201*a*) to the position 201*b* (see FIG. 15 also). The CPU 70 then determines whether or not the staple command is indicative of oblique stapling (step S23). If the answer of the step S23 is YES, the CPU 70 drives the rotation motor 109 by a preselected number of pulses in order to rotate the stapler S counterclockwise by 45° (step S24), as stated previously. If the answer of the step S21 is YES or if the answer of the step S23 is NO, meaning that the staple command is indicative of horizontal stapling, the CPU 70 ends the procedure, determining that the stapler S (slider 102) does not have to be rotated.

Figure 18:
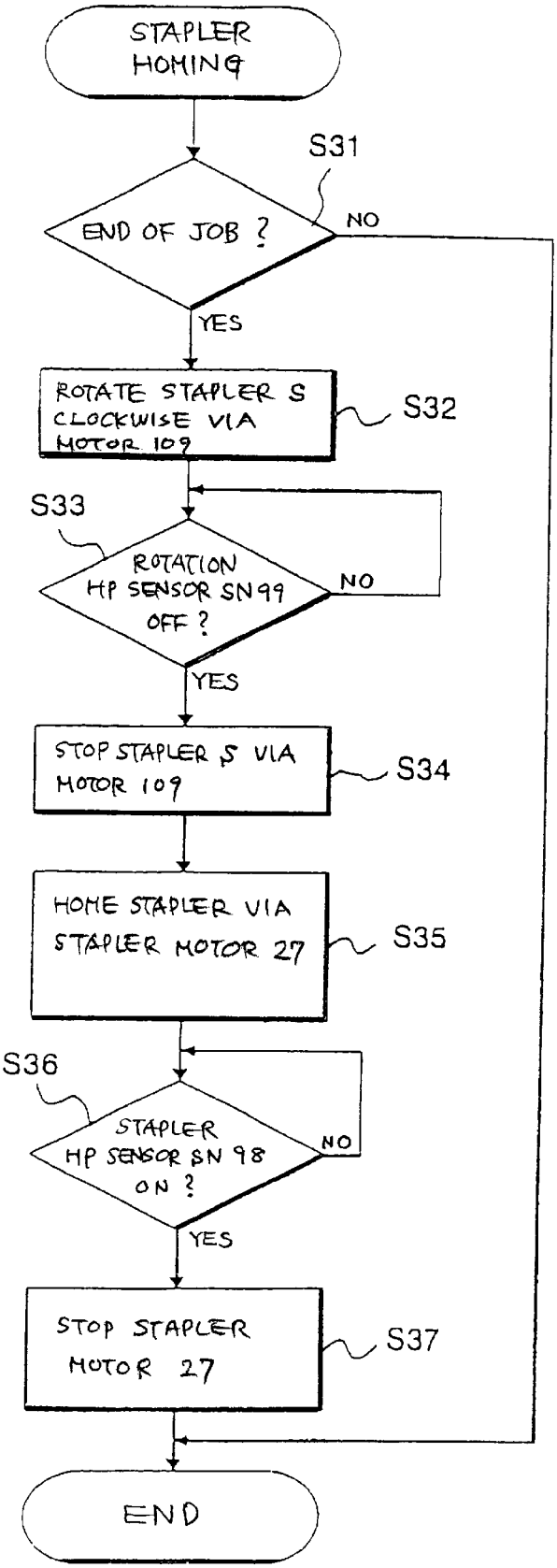
FIG. 18 is a flowchart for homing the stapler.

FIG. 18 shows a procedure for homing the stapler S after the above oblique stapling operation. As shown, the CPU 70 determines whether or not the job has ended (step S31). If the answer of the step S31 is YES, the CPU 70 drives the rotation motor 109 in order to rotate the stapler S clockwise (step S32). As soon as the rotation home position sensor SN99 turns off (YES, step S33), the CPU 70 stops driving the rotation motor 109 and therefore the rotation of the stapler S (step S34). Subsequently, the CPU 70 drives the stapler motor 27 in order to move the stapler S toward its home position 201*f* (step S35). When the stapler home position sensor SN98 turns on, the CPU 70 stops driving the stapler motor 27 and therefore the movement of the stapler S. If the answer of the step S31 is NO, meaning that the job has not ended yet, the CPU 70 ends the procedure.

Assume that a stapler near-end sensor, not shown, built in the stapler S determines that the stapler S is about to run out of staples while a job is under way. Then, the resulting stapler near-end signal is sent to the copier A. In response, the copier A returns a stapler near-end signal to the stapling device B during an interval between consecutive jobs. In response, if the oblique staple mode operation is under way, the device B drives the rotation motor 109 in order to rotate the stapler S clockwise. When the rotation home position sensor SN99 turns on and then turns off, the device B stops driving the rotation motor 109 and then drives the stapler motor 27 for moving the stapler S from the rear position 201*b* to the front position or home position (HP) 201*f*. If the oblique staple mode is not under way, the device B drives the stapler motor 27 without driving the rotation motor 109, thereby returning the stapler S to the home position HP.

Subsequently, the device B drives the rotation motor 109 by a preselected number of pulses so as to rotate the stapler S clockwise by 90°. While the stapler S is held in this position, the operator replenishes staples to the stapler S. As soon as the staple near-end sensor stops outputting the near-end signal due to the replenishment of staples, the device B drives the rotation motor 109 in order to rotate the stapler S counterclockwise until the rotation home position sensor SN99 turns on. The device B then stops driving the rotation motor 109 and then reverses it until the sensor SN99 turns off, thereby locating the stapler S at the home position HP. Thereafter, the device B returns the stapler S to the previous stapling position.

Figure 19:
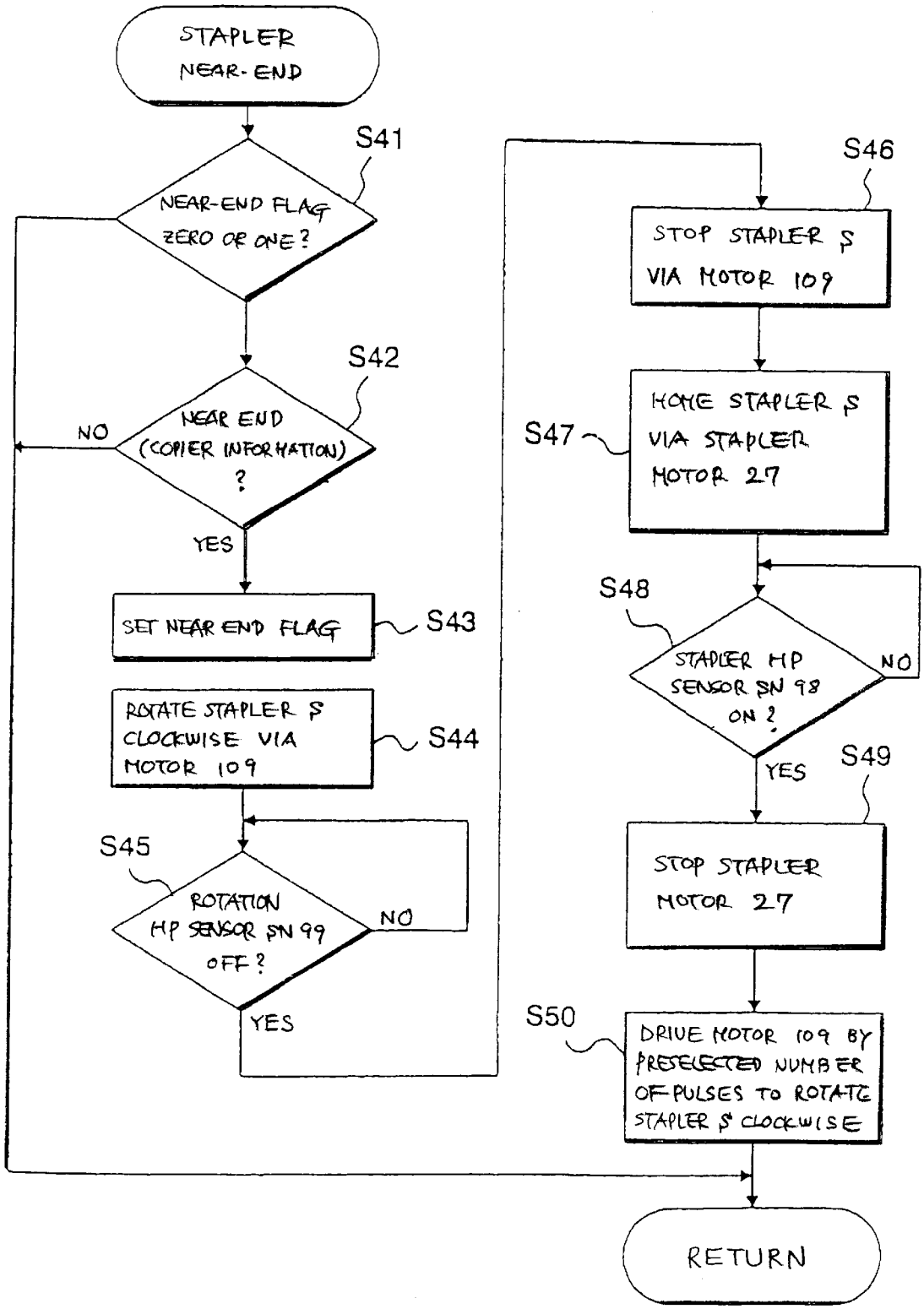
FIG. 19 is a flowchart showing a procedure to be executed in a staple near-end condition.

FIG. 19 shows the above procedure dealing with the staple near-end condition more specifically. As shown, when the staple near-end signal is sent from the binding device B to the copier A, the copier A returns a staple near-end signal to the device B during an interval between consecutive jobs. In response, the CPU 70 of the binding device B determines whether a near-end flag received from the copier A is (logical) ZERO or (logical) ONE (step S41). If the near-end flag is ZERO, the CPU 70 determines whether or not the staple near-end signal has been derived from copier A information (step S42). If the answer of the step S42 is YES, the CPU 70 makes the near-end flag ONE (step S43) and then drives the rotation motor 109 so as to rotate the stapler S clockwise by 45° (step S44). As soon as the rotation home position sensor SN99 turns off (YES, step S45), the CPU 70 stops driving the rotation motor 109 and therefore the rotation of the stapler S (step S46), thereby locating the stapler S at the rotation home position.

Subsequently, the CPU 70 drives the stapler motor 27 for moving the stapler S from the position 201*b* of the cam 201*a* to the home position 201*f* (step S47). When the home position sensor SH98 turns on, the CPU 70 stops driving the stapler motor 27 so as to locate the stapler S at the home position HP (step S49). The CPU 70 then drives the rotation motor 109 by a preselected number of pulses in order to rotate the stapler S clockwise by 90° (step S50). If the near-end flag is ONE, as determined in the step S41, or if the near-end signal is not derived from the copier A information (NO, step S42), the CPU 70 ends the procedure.

Figure 20:
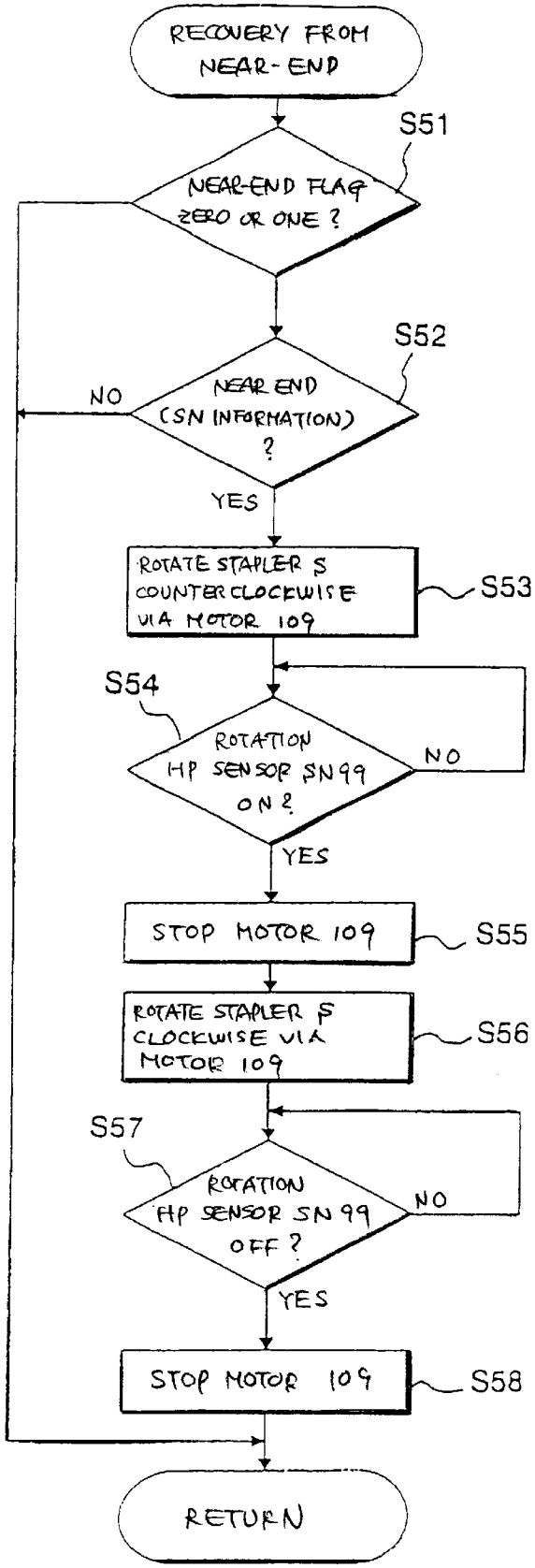
FIG. 20 is a flowchart showing a staple near-end recovery procedure.

As for the recovery from the stapler near-end condition, assume that the near-end sensor stops outputting the near-end signal due to the replenishment of staples to the stapler S. Then, as shown in FIG. 20 specifically, the CPU 70 determines whether the near-end flag is ZERO or ONE (step S51). If the near-end flag is ONE, the CPU 70 determines whether or not the near-end condition is derived from the output of the rotation home position sensor SN99 (step S52). If the answer of the step S52 is YES, the CPU 70 drives the rotation motor 109 in order to rotate the stapler S counterclockwise (step 53) until the rotation home position sensor SN99 turns on (YES, step S54). The CPU 70 then stops driving the rotation motor 109 (step S55) and again drives it for rotating the stapler S clockwise (step S56). When the rotation home position sensor SN99 turns off (YES, step S57), the CPU 70 stops driving the rotation motor 109 (step S58). If the near-end flag is ZERO, as determined in the step S51, or if the near-end condition is not derived from the sensor SN99, the CPU 70 ends the processing.

Figure 13:
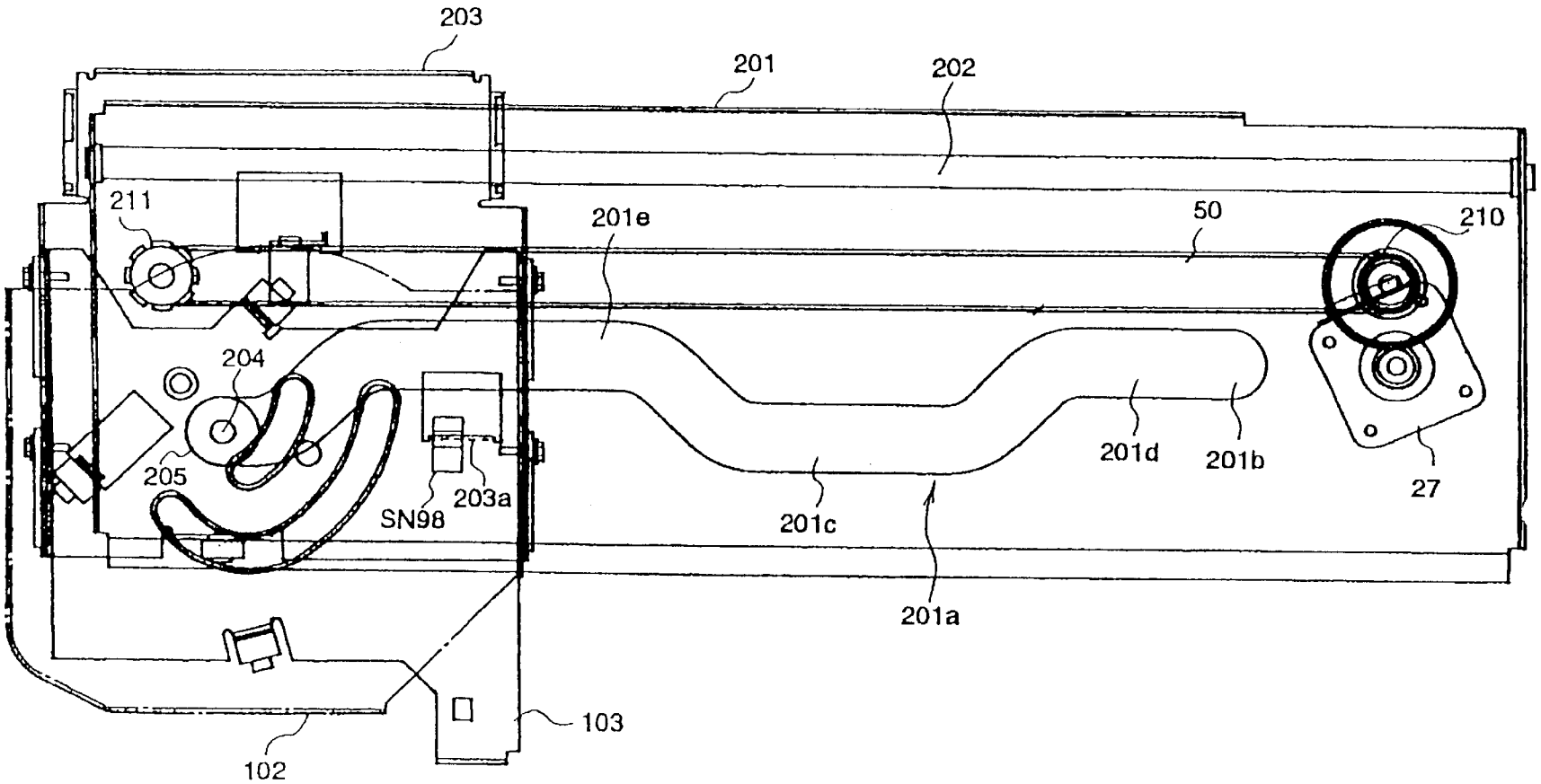
FIG. 13 is a front view showing the stapler located at a home position.
Figure 14:
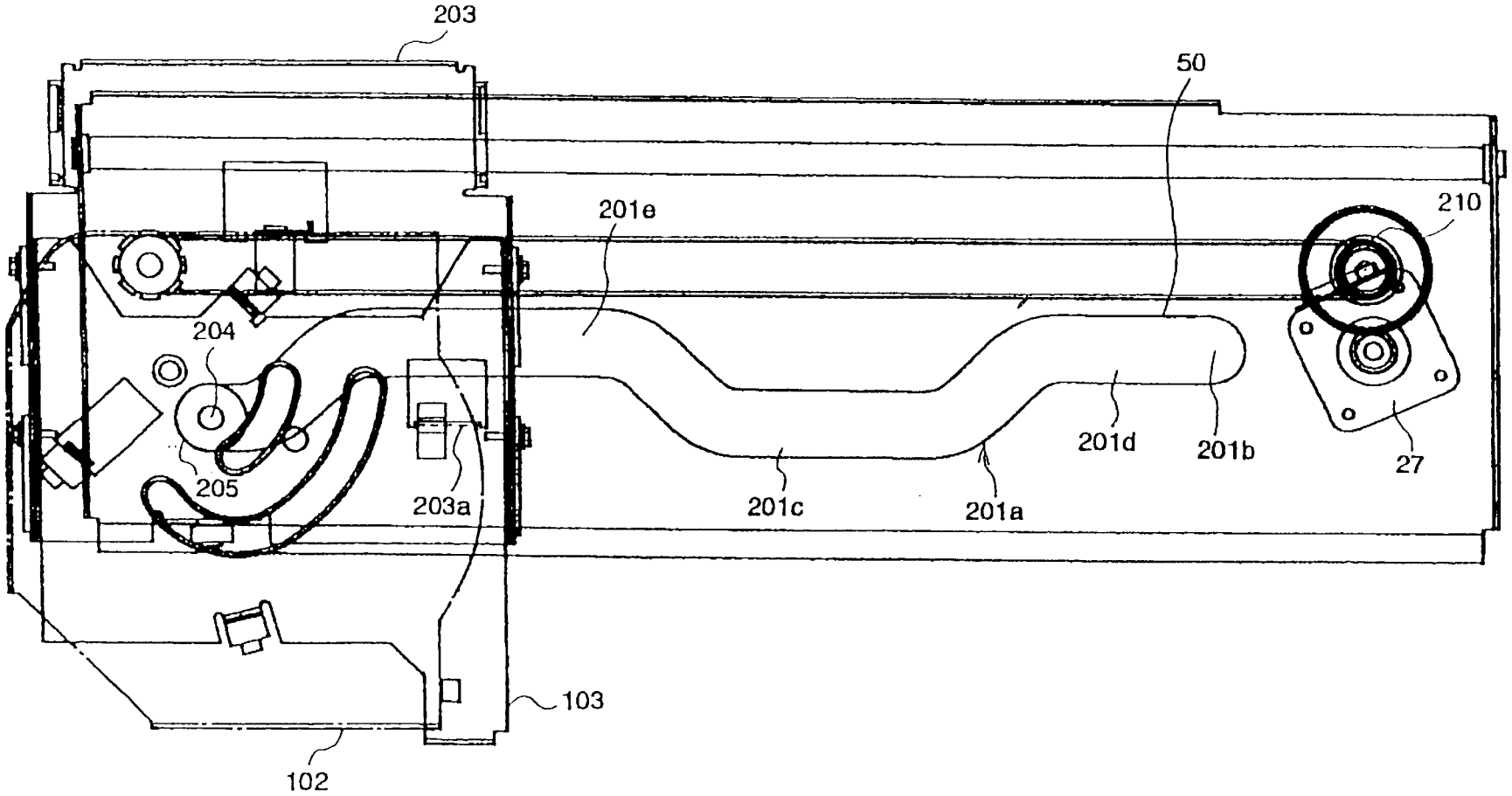
FIG. 14 is a front view showing the stapler held at a waiting position.
Figure 21:
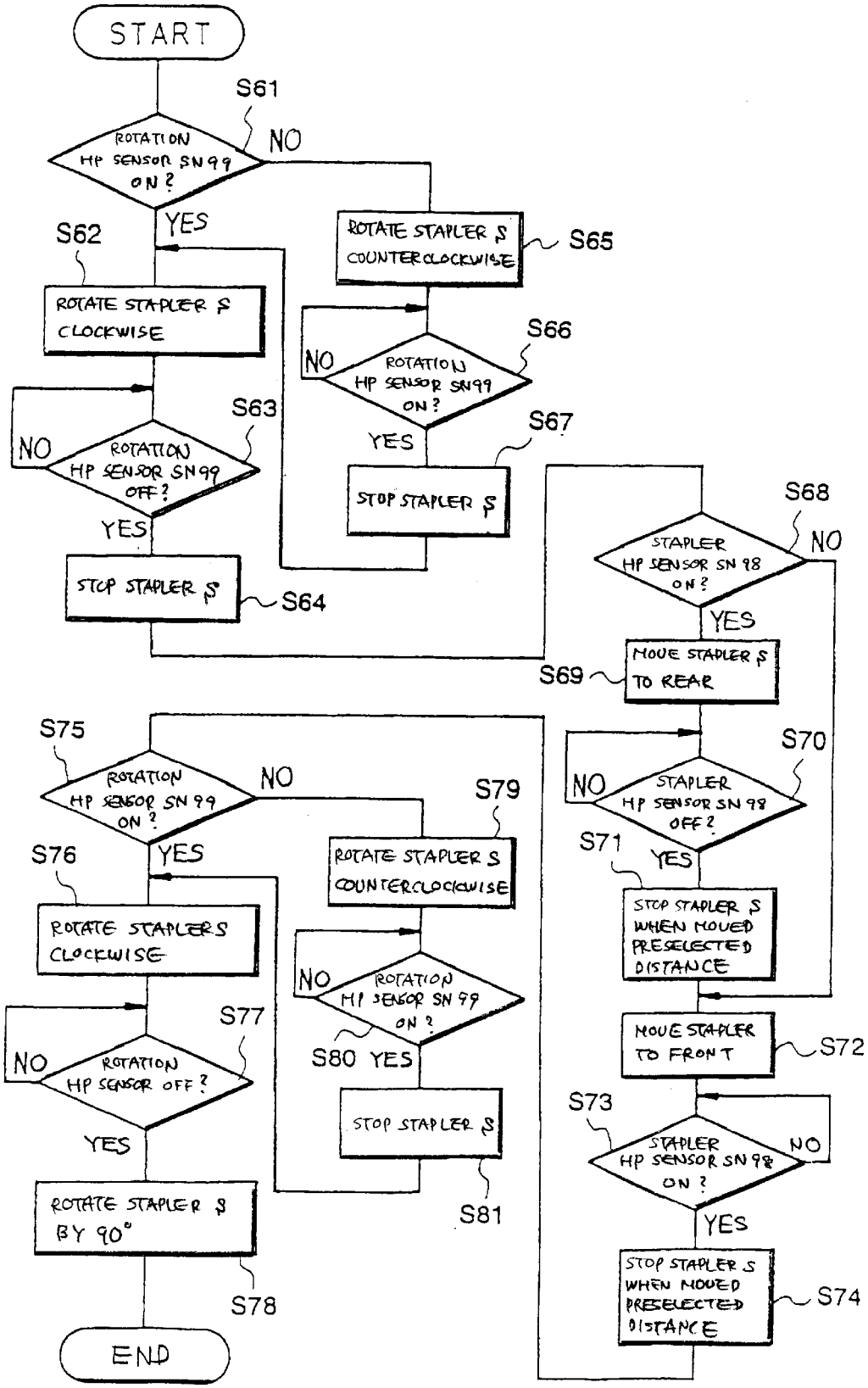
FIG. 21 is a flowchart showing a procedure for initializing the oblique position of the stapler.

In the illustrative embodiment, when the stapler S is in its home position, the base 103 is located at the position 201*f*, FIG. 13, while a clincher included in the stapler S faces upward, as shown in FIG. 7, as stated previously. As shown in FIG. 14, the stapler S remains in a waiting position with the slider 102 rotated clockwise by 90° from the home position. Because the rotation home position sensor turns on when the pinion gear 106*a* meshes with the rack 105*a* or turns off when it meshes with the rack 105*b*, it is necessary to detect the rotation home position. FIG. 21 shows a procedure necessary for locating the stapler S at the waiting position.

Specifically, FIG. 21 demonstrates a stapler initializing procedure relating to the angular position. As shown, the CPU 70 determines whether or not the rotation home position sensor SN99 is in an ON state (step S61). If the answer of the step S61 is YES, the CPU 70 starts driving the rotation motor 109 for causing the stapler S to rotate clockwise (step S62). When the rotation home position sensor SN99 turns off (YES, step S63), the CPU 70 stops driving the rotation motor 109 and therefore the rotation of the stapler 8 (step S64).

If the answer of the step S61 is NO, the CPU 70 drives the rotation motor 109 (step S65) until the rotation home position sensor SN99 turns on (YES, step S66). The CPU 70 then stops driving the rotation motor 109 and therefore the counterclockwise rotation of the stapler S (step S67), and advances to the step S62. At this stage of the procedure, the home position of the stapler S with respect to rotation has been determined, but the position of the stapler S with respect to movement along the trailing edge of a paper stack (horizontal direction) has not been determined yet. The CPU 70 therefore determines whether or not the stapler home position sensor SN98 is in an ON state (step S68).

If the answer of the above step S68 is YES, the CPU 70 drives the stapler motor 27 in order to move the stapler S toward the rear position 201*b*. As soon as the stapler home position sensor SN98 turns off (YES, step S70), the CPU 70 stops driving the stapler motor 27 (step S71). Subsequently, the CPU 70 moves the stapler S toward the front position 201*f* (step S72) until the stapler home position sensor SN98 turns on (YES, step S73). The CPU 70 then drives the stapler motor 27 by a preselected number of pulses in order to move the stapler S and then stops driving it (step S74). This position where the stapler S is brought to a stop is the position 201*f* where the base 103 stops moving, i.e., the home position of the stapler S shown in FIG. 13.

After determining the home position of the stapler S in the horizontal direction by the above steps, the CPU 70 determines whether or not the home position sensor SN99 is in an ON state (step S75). If the answer of the step S75 is YES, the CPU 70 drives the rotation motor 109 and thereby causes the stapler S to start rotating clockwise (step S76). When the rotation home position sensor SN99 turns off (YES, step S77), the CPU 70 stops driving the rotation motor 109 and therefore the rotation of the stapler S (step S78). This is the waiting position of the stapler S and corresponds to the position of the stapler S rotated by 90° from the rotation home position, as shown in FIG. 14.

If the answer of the step S75 is NO, the CPU 70 causes the stapler S to rotate counterclockwise via the rotation motor 109 (step S79) until the rotation home position sensor SN99 turns on (step S80). The CPU 70 then stops driving the rotation motor 109 and therefore the rotation of the stapler S (step S81). The step S81 is followed by the step S76.

At the time of power-up, the CPU 70 can recognize only the ON/OFF status of the rotation home position sensor SN99 and that of the stapler home position sensor SN98, i.e., it cannot determine the actual position of the stapler S or the actual angular position of the same. This is why the waiting position of the stapler S is initialized at the time of power-up. Control to follow is executed on the basis of the initialized waiting position of the stapler S.

In FIG. 21, the steps S61 through S67 define the horizontal position of the stapler S with respect to rotation while the steps S68 through S74 define the home position of the same with respect to horizontal movement. Further, the steps S75 through S78 define the waiting position of the stapler S.

In summary, it will be seen that the present invention provides a finisher for an image forming apparatus having various unprecedented advantages, as enumerated below.

(1) The finisher includes two axes of rotation for allowing binding means to rotate over a great angle within a narrow range and is therefore miniature. Should the binding means be rotated toward the front by, e.g., 90°, as in the conventional arrangement, the front part of the finisher would become bulky. Further, when the binding means is implemented as a stapler, it is possible to leave the axis of rotation adjoining the clincher of the stapler for oblique stapling, as in the conventional arrangement. The finisher therefore allows the binding means to move the same distance in both of a horizontal bind mode and an oblique bind mode like the conventional finisher.

(2) When one of the two axes of rotation is functioning, the other axis of rotation serves as a support. This simplifies the configuration of the finisher and thereby enhances reliable operation.

(3) Accurate rotation is achievable because the loci of rotation are defined on a support body.

(4) The support body has a simple configuration including a first and a second support member and a first and a second center shaft. The first and second support members are formed with a first and a second elongate slot, respectively. This is also desirable from the miniature configuration and reliable operation standpoint.

(5) The binding means can be provided with a waiting position, a staple replacing position and an oblique binding position by a simple arrangement.

(6) The finisher needs a minimum of drive torque and is therefore miniature and saves energy.

(7) The axis of rotation adjoins a binding position and allows oblique binding to be effected with high positional accuracy.

(8) A gear mechanism constitutes a drive mechanism alone, further simplifying the construction of the finisher.

(9) The fulcrums of rotation are replaced with each other by a smooth circular motion. This further enhances the simple construction and reliable operation.

(10) An angular position can be determined by control over a stepping motor, so that a sensor responsive to the position of the binding means is not necessary. This not only reduces the number of sensors, but also allows the angular position to be changed on a software basis.

(11) A single motor implements the rotational movement and simplifies the construction while reducing the cost.

(12) At a home position, holding means and a stapler can be surely spaced from each other, insuring safety operation.

(13) The stapler is located at a waiting position that is easiest to operate and to see. By using such a waiting position for all movements, it is possible to reduce loads on software and mishandling.

(14) Staples are easy to replace.

(15) The initial position can be surely set and promotes accurate control to follow.

(16) At the time of replacement of staples, the opening of the binding means faces the operator. The finisher is therefore extremely easy to operate.

(17) The binding means can move between a needle replacing position and a stapling position and can perform a particular operation at each of the two positions by linear movement and angular movement. This makes the finisher more miniature and easier to operation.

Various modifications will become possible for those skilled in the art after receiving the teachings of the present disclosure without departing from the scope thereof.

What is claimed is:

1. A finisher comprising:

at least one binding means for binding a paper stack; and a rotating device configured to rotate said at least one binding means relative to said paper stack to thereby bind said paper stack either horizontally or obliquely, wherein said binding means is supported by a support body including two axes of rotation relative to said paper stack, and said support body comprises, a first support member supporting said binding means, a second support member facing said first support member at a preselected distance and configured to rotatably support said first support member, a first center shaft affixed to said first support member at one end of said first center shaft and configured to be movably received in a first slot formed in said second support member at an opposite end of said first center shaft, said first slot coinciding with a locus along which said first support member rotates by a first angle, and a second center shaft affixed at one end to said second support member and configured to be movably received at an opposite end in a second slot formed in said first support member, said second slot coinciding with a locus along which said second support member rotates by a second angle.

2. A finisher as claimed in claim 1, wherein said binding means is configured to be rotated with said two axes of rotation rotating about each other.

3. A finisher as claimed in claim 2, wherein said binding means is configured to be rotated about only one of said two axes of rotation.

4. A finisher as claimed in claim 3, wherein said binding means is configured to be rotated about one of said two axes of rotation by substantially 45° or rotated about the other axis of rotation by substantially 90°.

5. A finisher as claimed in claim 4, wherein a locus of movement of each of said two axes of rotation is formed in said support body.

6. A finisher as claimed in claim 3, wherein a locus of movement of each of said two axes of rotation is formed in said support body.

7. A finisher as claimed in claim 2, wherein said binding means is configured to be rotated about one of said two axes of rotation by substantially 45° or rotated about the other axis of rotation by substantially 90°.

8. A finisher as claimed in claim 7, wherein a locus of movement of each of said two axes of rotation is formed in said support body.

9. A finisher as claimed in claim 2, wherein a locus of movement of each of said two axes of rotation is formed in said support body.

10. A finisher as claimed in claim 1, wherein said binding means is configured to be rotated about one of said two axes of rotation by substantially 45° or rotated about the other axis of rotation by substantially 90°.

11. A finisher as claimed in claim 10, wherein a locus of movement of each of said two axes of rotation is formed in said support body.

12. A finisher as claimed in claim 1, wherein a locus of movement of each of said two axes of rotation is formed in said support body.

13. A finisher as claimed in claim 1, further comprising:

a drive gear train mounted on said first support member; and a stationary gear meshing with a last gear of said gear train mounted on said second support member.

14. A finisher as claimed in claim 13, wherein said stationary gear comprises:

a rack positioned on a curve connecting a first arc having said first center shaft at a center and a second arc having said second center shaft at a center, such that an inflection point that smoothly connects said first arc and said second arc is positioned on an extension of a line that connects said first center shaft and said second center shaft.

15. A finisher as claimed in claim 14, wherein said binding means comprises:

a first home position corresponding to the inflection point with respect to rotation.

16. A finisher as claimed in claim 15, further comprising:

a stepping motor under pulse control causes said binding means to start rotating at said first home position.

17. A finisher as claimed in claim 13, further comprising:

a single motor configured to drive said drive gear train is mounted on said first support member and causes said binding means to rotate.

18. A finisher as claimed in claim 1, wherein said binding means is movable from a front side to a rear side of said finisher along a trailing edge of the paper stack in a direction of paper conveyance, and said binding means further comprises:

a second home position at said front side and retracted by a preselected distance from a holding device configured to hold a trailing edge of the paper stack with respect to a movement along said trailing edge of said paper stack.

19. A finisher as claimed in claim 18, wherein said holding device comprises:

a rear fence configured to position the rear edge of the paper stack.

20. A finisher as claimed in claim 18, wherein said binding means has a waiting position rotated by substantially 90° from said second home position about said first center shaft, said binding means being held at said waiting position when not performing a stapling operation.

21. A finisher as claimed in claim 20, wherein said waiting position coincides with a staple replacing position.

22. A finisher as claimed in claim 20, wherein said binding means is configured to sequentially be moved to said waiting position by sensing said first home position, sensing said second home position, sensing said first home position, and then to start rotating said binding means to a position where said first position is again sensed.

23. A finisher comprising:

at least one binding means for binding a paper stack; and a rotating device configured to rotate said at least one binding means relative to said paper stack to thereby bind said paper stack either horizontally or obliquely, wherein said binding means is rotatably supported by a support body such that a staple replacing portion of said binding means faces an opening formed in said finisher, and said support body comprises, a first support member supporting said binding means, a second support member facing said first support member at a preselected distance and configured to rotatably support said first support member, a first center shaft affixed to said first support member at one end of said first center shaft and configured to be movably received in a first slot formed in said second support member at an opposite end of said first center shaft, said first slot coinciding with a locus along which said first support member rotates by a first angle, and a second center shaft affixed at one end to said second support member and configured to be movably received at an opposite end in a second slot formed in said first support member, said second slot coinciding with a locus along which said second support member rotates by a second angle.

24. A finisher as claimed in claim 23, wherein said binding means is movable along a trailing edge of a paper stack and supported such that said binding means is rotatable by substantially 90° in a direction in which said staple replacing portion is capable of facing said opening or rotatable by substantially 45° in an opposite direction.

* * * * *

UNITED STATES PATENT AND TRADEMARK OFFICE

CERTIFICATE OF CORRECTION

PATENT NO. : 6,343,785 B1
DATED : February 5, 2002
INVENTOR(S) : Yamada et al.

It is certified that error appears in the above-identified patent and that said Letters Patent is hereby corrected as shown below:

Title page,
Item [30], the Foreign Application Priority information should read:
-- [30] Foreign Application Priority Data
Mar. 23, 1999 (JP) …….. 11-078356
Feb. 3, 2000 (JP) ……2000-026864 --

Signed and Sealed this

Eighteenth Day of June, 2002

*Attest:*

*Attesting Officer*

JAMES E. ROGAN
*Director of the United States Patent and Trademark Office*